US009458520B2

(12) United States Patent
Toda et al.

(10) Patent No.: US 9,458,520 B2
(45) Date of Patent: *Oct. 4, 2016

(54) MANUFACTURING METHOD OF A HIGH-STRENGTH COLD-ROLLED STEEL SHEET HAVING EXCELLENT UNIFORM ELONGATION AND HOLE EXPANDABILITY

(75) Inventors: Yuri Toda, Tokyo (JP); Riki Okamoto, Tokyo (JP); Nobuhiro Fujita, Tokyo (JP); Kohichi Sano, Tokyo (JP); Hiroshi Yoshida, Tokyo (JP); Toshio Ogawa, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 415 days.

This patent is subject to a terminal disclaimer.

(21) Appl. No.: 14/112,187

(22) PCT Filed: Apr. 19, 2012

(86) PCT No.: PCT/JP2012/060634

§ 371 (c)(1),
(2), (4) Date: Oct. 16, 2013

(87) PCT Pub. No.: WO2012/144567

PCT Pub. Date: Oct. 26, 2012

(65) Prior Publication Data

US 2014/0044989 A1 Feb. 13, 2014

(30) Foreign Application Priority Data

Apr. 21, 2011 (JP) ..... 2011-095254

(51) Int. Cl.
*C21D 8/02* (2006.01)
*C23C 2/02* (2006.01)
(Continued)

(52) U.S. Cl.
CPC ..... *C21D 8/0263* (2013.01); *C21D 8/0226* (2013.01); *C21D 8/0236* (2013.01);
(Continued)

(58) Field of Classification Search
None
See application file for complete search history.

(56) References Cited

U.S. PATENT DOCUMENTS

2003/0196735 A1 10/2003 Sugiura et al.
2006/0096678 A1 5/2006 Kariya
(Continued)

FOREIGN PATENT DOCUMENTS

CN 1462317 A 12/2003
CN 1989267 A 6/2007
(Continued)

OTHER PUBLICATIONS

Chinese Office Action and Search Report dated Dec. 16, 2014, for Chinese Application No. 201280018923.9.
(Continued)

*Primary Examiner* — Deborah Yee
(74) *Attorney, Agent, or Firm* — Birch, Stewart, Kolasch & Birch, LLP

(57) ABSTRACT

This high-strength cold-rolled steel sheet having excellent uniform elongation and hole expandability contains, C: 0.01 to 0.4%; Si: 0.001 to 2.5%; Mn: 0.001 to 4.0%; P: 0.001 to 0.15%; S: 0.0005 to 0.03%; Al: 0.001 to 2.0%; N: 0.0005 to 0.01%; and O: 0.0005 to 0.01%; in which Si+Al is limited to less than 1.0%, and a balance being composed of iron and inevitable impurities, in which at a sheet thickness center portion, an average value of pole densities of the {100}<011> to {223}<110> orientation group is 5.0 or less, and a pole density of the {332}<113> crystal orientation is 4.0 or less, a metal structure contains 5 to 80% of ferrite, 5 to 80% of bainite, and 1% or less of martensite in terms of an area ratio and the total of martensite, pearlite, and retained austenite is 5% or less, and an r value (rC) in a direction perpendicular to a rolling direction is 0.70 or more and an r value (r30) in a direction 30° from the rolling direction is 1.10 or less.

9 Claims, 1 Drawing Sheet

(51) Int. Cl.

| | |
|---|---|
| ***C23C 2/06*** | (2006.01) |
| ***C23C 2/26*** | (2006.01) |
| ***C23C 2/28*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/08*** | (2006.01) |
| ***C22C 38/16*** | (2006.01) |
| ***C22C 38/22*** | (2006.01) |
| ***C22C 38/28*** | (2006.01) |
| ***C22C 38/32*** | (2006.01) |
| ***C22C 38/38*** | (2006.01) |
| ***C21D 9/46*** | (2006.01) |

(52) U.S. Cl.

CPC ..... *C21D 9/46* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/22* (2013.01); *C22C 38/28* (2013.01); *C22C 38/32* (2013.01); *C22C 38/38* (2013.01); *C23C 2/02* (2013.01); *C23C 2/06* (2013.01); *C23C 2/28* (2013.01); *C21D 2211/002* (2013.01); *C21D 2211/005* (2013.01); *Y10T 428/12799* (2015.01)

(56) References Cited

U.S. PATENT DOCUMENTS

| | | | | |
|---|---|---|---|---|
| 2008/0008901 | A1 | 1/2008 | Sugiura et al. | |
| 2009/0014095 | A1 | 1/2009 | Mukai et al. | |
| 2010/0047617 | A1 | 2/2010 | Sugiura et al. | |
| 2013/0153091 | A1* | 6/2013 | Fujita | C21D 8/0226 148/504 |
| 2013/0323112 | A1* | 12/2013 | Okamoto | C22C 38/001 420/83 |

FOREIGN PATENT DOCUMENTS

| | | | |
|---|---|---|---|
| CN | 101535519 | A | 9/2009 |
| JP | 2004-263270 | A | 9/2004 |
| JP | 2007-291500 | A | 11/2007 |
| JP | 2009-249733 | A | 10/2009 |
| JP | 2009-263718 | A | 11/2009 |

OTHER PUBLICATIONS

Extended European Search Report dated Dec. 12, 2014, issued in corresponding European Patent Application No. 12774097.5.

Taiwanese Office Action for Taiwanese Application No. 101114134 dated Feb. 14, 2014.

International Search Report issued in PCT/JP2012/060634, mailed on Jul. 24, 2012.

Katoh et al., "Development of New High-Strength Hot-Rolled Steel Sheets", Steelmaking Research, 1984, vol. 312, pp. 41-50.

Matsumura et al., "Enhancement of Elongation by Retained Austenite in Intercritical Annealed 0.4C-1.5Si-0.8Mn Steel", Transactions ISIJ, vol. 27, 1987, pp. 570-579.

Sugimoto, K. et al. "Stretch-flangeability of a High-strength TRIP Type Bainitic Sheet Steel," ISIJ International, 2000, vol. 40, No. 9, pp. 920-926.

Takahashi, "Development of High Strength Steels for Automobiles", Nippon Steel Technical Report, No. 88, Jul. 2003, pp. 2-6.

Written Opinion of the International Searching Authority issued in PCT/JP2012/060634, mailed on Jul. 24, 2012. (Japanese).

Mexican Office Action dated Jun. 1, 2015, for Mexican Application No. MX/a/2013/012116 with the a partial English translation.

* cited by examiner

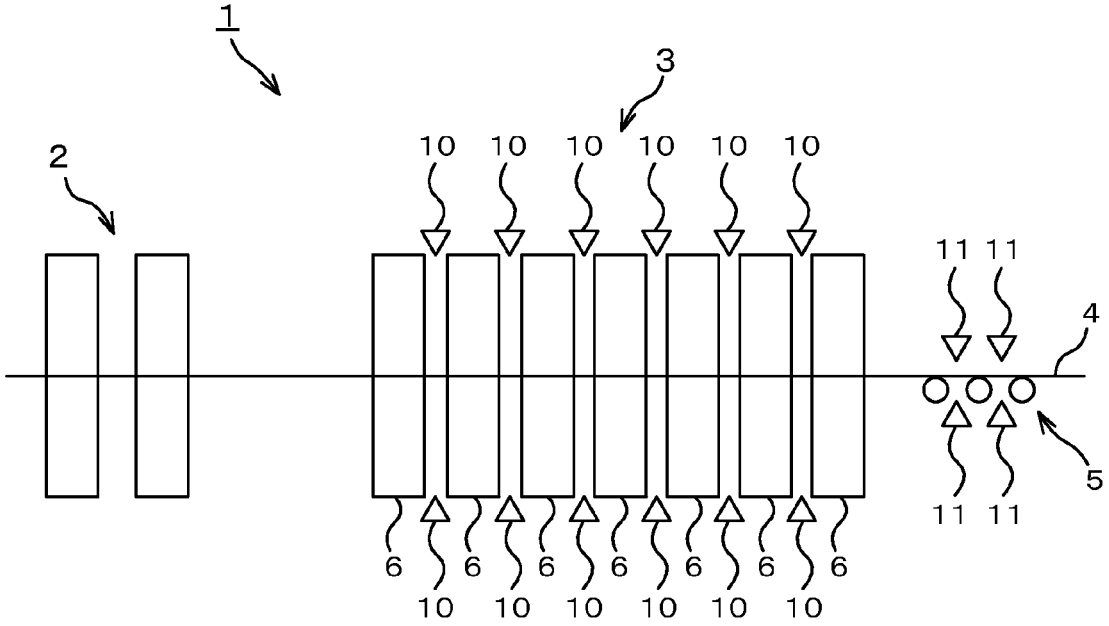
1
2
3
10 10 10 10 10 10
11 11
4
5
11 11
6 6 6 6 6 6 6
10 10 10 10 10 10

MANUFACTURING METHOD OF A HIGH-STRENGTH COLD-ROLLED STEEL SHEET HAVING EXCELLENT UNIFORM ELONGATION AND HOLE EXPANDABILITY

TECHNICAL FIELD

The present invention relates to a high-strength cold-rolled steel sheet having excellent uniform elongation and hole expandability that is mainly used for automobile parts and the like, and a manufacturing method thereof.

This application is based upon and claims the benefit of priority of the prior Japanese Patent Application No. 2011-095254, filed on Apr. 21, 2011, the entire contents of which are incorporated herein by reference.

BACKGROUND ART

In order to abate emission of carbon dioxide gas from automobiles, a reduction in weight of automobile vehicle bodies has been promoted by using high-strength steel sheets. Further, in order also to secure the safety of a passenger, a high-strength steel sheet has been increasingly used for an automobile vehicle body in addition to a soft steel sheet. In order to further promote the reduction in weight of automobile vehicle bodies from now on, the strength of the high-strength steel sheet has to be increased more than conventionally.

In order to use the high-strength steel sheet for an underbody part, for example, burring workability has to be improved in particular. However, when a steel sheet is increased in strength in general, formability decreases, and uniform elongation important for drawing and bulging decreases.

In Non-Patent Document 1, there is disclosed a method in which austenite is made to remain in a steel sheet structure to secure uniform elongation. Further, in Non-Patent Document 2, there is disclosed a method of securing uniform elongation with the same strength by making a metal structure of a steel sheet complex.

Meanwhile, there is also disclosed control of a metal structure that improves local ductility necessary for bending, hole expanding, and burring. Non-Patent Document 3 discloses that controlling inclusions, making a structure uniform, and further decreasing hardness difference between structures are effective for improvement of bendability and hole expandability.

This is a method to improve the hole expandability by making a structure uniform by structure control, but in order to make a structure uniform, a heat treatment from an austenite single phase becomes a basis as disclosed in Non-Patent Document 4.

In order to attain achievement of strength and ductility, Non-Patent Document 4 discloses that a transformation structure is controlled by cooling control, thereby obtaining appropriate fractions of ferrite and bainite. However, all the cases are to improve local deformability relying on the structure control, and desired properties are greatly affected by how the structure is formed.

Meanwhile, as a method of improving a material of a hot-rolled steel sheet, there is disclosed a technique of increasing a reduction amount in continuous hot rolling. This is what is called a technique of making crystal grains fine, in which heavy reduction is performed at as low temperature as possible in an austenite region and non-recrystallized austenite is transformed to ferrite, to achieve making crystal grains of ferrite, which is the main phase of a product, fine.

Non-Patent Document 5 discloses that by this grain refining, increasing strength and increasing toughness are aimed. However, Non-Patent Document 5 pays no attention to the improvement of hole expandability, which is desired to be solved by the present invention, and does not disclose also a means applied to a cold-rolled steel sheet.

PRIOR ART DOCUMENT

[Non-Patent Document]

Non-Patent Document 1: Takahashi, Nippon Steel Technical Report (2003) No. 378, p. 7

Non-Patent Document 2: O. Matsumura et al., Trans. ISIJ (1987) vol. 27, p. 570

Non-Patent Document 3: Kato et al., Steelmaking Research (1984) vol. 312, p. 41

Non-Patent Document 4: K. Sugimoto et al., (2000) Vol. 40, p. 920

Non-Patent Document 5: Nakayama Steel Works, Ltd. NFG Catalog

DISCLOSURE OF THE INVENTION

Problems to be Solved by the Invention

As described above, performing structure control including inclusions is the main method for improving local ductility performance of a high-strength steel sheet. However, since the structure control is performed, form of precipitates and fractions of ferrite and bainite need to be controlled, and it is essential to limit a metal structure to be a base.

Thus, the present invention has a task to improve uniform elongation and burring workability of a high-strength steel sheet and improve also anisotropy in the steel sheet by controlling the fractions and form of a metal structure to be a base and controlling a texture. The present invention has an object to provide a high-strength cold-rolled steel sheet having excellent uniform elongation and hole expandability that solves this task, and a manufacturing method thereof.

Means for Solving the Problems

The present inventors earnestly examined a method of solving the above-described task. As a result, it was found that when rolling conditions and cooling conditions are controlled to required ranges to form a predetermined texture and steel sheet structure, a high-strength cold-rolled steel sheet having excellent isotropic workability can be thereby manufactured.

The present invention is made based on the above-described knowledge and the gist thereof is as follows.

A high-strength cold-rolled steel sheet having excellent uniform elongation and hole expandability contains:

in mass %,

C: 0.01 to 0.4%;

Si: 0.001 to 2.5%;

Mn: 0.001 to 4.0%;

P: 0.001 to 0.15%;

S: 0.0005 to 0.03%;

Al: 0.001 to 2.0%;

N: 0.0005 to 0.01%; and

O: 0.0005 to 0.01%; in which Si+Al is limited to less than 1.0%, and a balance being composed of iron and inevitable impurities, in which at a sheet thickness center portion being a range of ⅝ to ⅜ in sheet thickness from the surface of the steel sheet, an average value of pole densities of the {100}<011> to {223}<110> orientation group represented by respective crystal orientations of {100}<011>, {116}<110>, {114}<110>, {113}<110>, {112}<110>, {335}<110>, and {223}<110> is 5.0 or less, and a pole density of the {332}<113> crystal orientation is 4.0 or less, a metal structure contains 5 to 80% of ferrite, 5 to 80% of bainite, and 1% or less of martensite in terms of an area ratio and the total of martensite, pearlite, and retained austenite is 5% or less, and an r value (rC) in a direction perpendicular to a rolling direction is 0.70 or more and an r value (r30) in a direction 30° from the rolling direction is 1.10 or less.

The high-strength cold-rolled steel sheet having excellent uniform elongation and hole expandability according to [1], in which an r value (rL) in the rolling direction is 0.70 or more and an r value (r60) in a direction 60° from the rolling direction is 1.10 or less.

The high-strength cold-rolled steel sheet having excellent uniform elongation and hole expandability according to [1], in which in the metal structure, a mean volume diameter of crystal grains is 7 μm or less, and an average value of a ratio of, of the crystal grains, a length dL in the rolling direction to a length dt in a sheet thickness direction: dL/dt is 3.0 or less.

The high-strength cold-rolled steel sheet having excellent uniform elongation and hole expandability according to [1], further contains:

one type or two or more types of in mass %,

Ti: 0.001 to 0.2%,
Nb: 0.001 to 0.2%,
B: 0.0001 to 0.005%,
Mg: 0.0001 to 0.01%,
Rem: 0.0001 to 0.1%,
Ca: 0.0001 to 0.01%,
Mo: 0.001 to 1.0%,
Cr: 0.001 to 2.0%,
V: 0.001 to 1.0%,
Ni: 0.001 to 2.0%,
Cu: 0.001 to 2.0%,
Zr: 0.0001 to 0.2%,
W: 0.001 to 1.0%,
As: 0.0001 to 0.5%,
Co: 0.0001 to 1.0%,
Sn: 0.0001 to 0.2%,
Pb: 0.001 to 0.1%,
Y: 0.001 to 0.10%, and
Hf: 0.001 to 0.10%.

The high-strength cold-rolled steel sheet having excellent uniform elongation and hole expandability according to [1], in which on the surface, hot-dip galvanizing is performed.

The high-strength cold-rolled steel sheet having excellent uniform elongation and hole expandability according to [1], in which after the hot-dip galvanizing, an alloying treatment is performed at 450 to 600° C.

A manufacturing method of a high-strength cold-rolled steel sheet having excellent uniform elongation and hole expandability, includes:

on a steel billet containing:

in mass %,

C: 0.01 to 0.4%;
Si: 0.001 to 2.5%;
Mn: 0.001 to 4.0%;
P: 0.001 to 0.15%;
S: 0.0005 to 0.03%;
Al: 0.001 to 2.0%;
N: 0.0005 to 0.01%; and
O: 0.0005 to 0.01%; in which Si+Al is limited to less than 1.0%, and a balance being composed of iron and inevitable impurities, performing first hot rolling in which rolling at a reduction ratio of 40% or more is performed one time or more in a temperature range of not lower than 1000° C. nor higher than 1200° C.;

setting an austenite grain diameter to 200 μm or less by the first hot rolling;

performing second hot rolling in which rolling at a reduction ratio of 30% or more is performed in one pass at least one time in a temperature region of not lower than a temperature T1+30° C. nor higher than T1+200° C. determined by Expression (1) below;

setting the total reduction ratio in the second hot rolling to 50% or more;

performing final reduction at a reduction ratio of 30% or more in the second hot rolling and then starting pre-cold rolling primary cooling in such a manner that a waiting time t second satisfies Expression (2) below;

setting an average cooling rate in the primary cooling to 50° C./second or more and performing the primary cooling in a manner that a temperature change is in a range of not less than 40° C. nor more than 140° C.;

performing cold rolling at a reduction ratio of not less than 30% nor more than 70%;

performing heating up to a temperature region of 700 to 900° C. and performing holding for not shorter than 1 second nor longer than 1000 seconds;

performing post-cold rolling primary cooling down to a temperature region of 580 to 750° C. at an average cooling rate of 12° C./second or less;

performing post-cold rolling secondary cooling down to a temperature region of 350 to 500° C. at an average cooling rate of 4 to 300° C./second; and performing an overaging heat treatment in which holding is performed for not shorter than t2 seconds satisfying Expression (4) below nor longer than 400 seconds in a temperature region of not lower than 350° C. nor higher than 500° C.

$$T1(^\circ\,C.)=850+10\times(C+N)\times Mn+350\times Nb+250\times Ti+40\times B+10\times Cr+100\times Mo+100\times V \quad (1)$$

Here, C, N, Mn, Nb, Ti, B, Cr, Mo, and V each represent the content of the element (mass %).

$$t\leq 2.5\times t1 \quad (2)$$

Here, t1 is obtained by Expression (3) below.

$$t1=0.001\times((Tf-T1)\times P1/100)^2-0.109\times((Tf-T1)\times P1/100)+3.1 \quad (3)$$

Here, in Expression (3) above, Tf represents the temperature of the steel billet obtained after the final reduction at a reduction ratio of 30% or more, and P1 represents the reduction ratio of the final reduction at 30% or more.

$$\log(t2)=0.0002(T2-425)^2+1.18 \quad (4)$$

Here, T2 represents an overaging treatment temperature, and the maximum value of t2 is set to 400.

The manufacturing method of the high-strength cold-rolled steel sheet having excellent uniform elongation and hole expandability according to [7], further includes:

after performing the pre-cold rolling primary cooling, performing pre-cold rolling secondary cooling down to a cooling stop temperature of 600° C. or lower at an average cooling rate of 10 to 300° C./second before performing the cold rolling, and performing coiling at 600° C. or lower to obtain a hot-rolled steel sheet.

The manufacturing method of the high-strength cold-rolled steel sheet having excellent uniform elongation and hole expandability according to [7], in which the total reduction ratio in a temperature range of lower than T1+30° C. is 30% or less.

The manufacturing method of the high-strength cold-rolled steel sheet having excellent uniform elongation and hole expandability according to [7], in which the waiting time t second further satisfies Expression (2a) below.

$$t<t1 \quad (2a)$$

The manufacturing method of the high-strength cold-rolled steel sheet having excellent uniform elongation and hole expandability according to [7], in which the waiting time t second further satisfies Expression (2b) below.

$$t1 \leq t \leq t1 \times 2.5 \quad (2b)$$

The manufacturing method of the high-strength cold-rolled steel sheet having excellent uniform elongation and hole expandability according to [7], in which post-hot rolling primary cooling is started between rolling stands.

The manufacturing method of the high-strength cold-rolled steel sheet having excellent uniform elongation and hole expandability according to [7], in which when the heating is performed up to the temperature region of 700 to 900° C. after the cold rolling, an average heating rate of not lower than room temperature nor higher than 650° C. is set to HR1 (° C./second) expressed by Expression (5) below, and an average heating rate of higher than 650° C. to 700 to 900° C. is set to HR2 (° C./second) expressed by Expression (6) below.

$$HR1 \geq 0.3 \quad (5)$$

$$HR2 \leq 0.5 \times HR1 \quad (6)$$

The manufacturing method of the high-strength cold-rolled steel sheet having excellent uniform elongation and hole expandability according to [7], further includes:

performing hot-dip galvanizing on the surface.

The manufacturing method of the high-strength cold-rolled steel sheet having excellent uniform elongation and hole expandability according to [14], further includes:

performing an alloying treatment at 450 to 600° C. after performing the hot-dip galvanizing.

Effect of the Invention

According to the present invention, it is possible to provide a high-strength cold-rolled steel sheet that is not large in anisotropy even when Nb, Ti, and/or the like are/is added and has excellent uniform elongation and hole expandability.

BRIEF DESCRIPTION OF THE DRAWINGS

FIG. 1 is an explanatory view of a continuous hot rolling line.

MODE FOR CARRYING OUT THE INVENTION

Hereinafter, the present invention will be explained in detail.

First, there will be explained a high-strength cold-rolled steel sheet having excellent uniform elongation and hole expandability of the present invention, (which will be sometimes called a "present invention steel sheet" hereinafter).

(Crystal Orientation)

In the present invention steel sheet, an average value of pole densities of the {100}<011> to {223}<110> orientation group at a sheet thickness center portion being a range of 5/8 to 3/8 in sheet thickness from the surface of the steel sheet is a particularly important characteristic value. As long as the average value of the pole densities of the {100}<011> to {223}<110> orientation group is 5.0 or less when X-ray diffraction is performed at the sheet thickness center portion being the range of 5/8 to 3/8 in sheet thickness from the surface of the steel sheet to obtain pole densities of respective orientations, it is possible to satisfy a sheet thickness/a bend radius ≥1.5 that is required to work a framework part to be required in recent years.

When the above-described average value exceeds 5.0, anisotropy of mechanical properties of the steel sheet becomes strong extremely, and further local deformability only in a certain direction is improved, but a material in a direction different from it deteriorates significantly, resulting in that it becomes impossible to satisfy the sheet thickness/the bend radius 1.5.

The average value of the pole densities of the {100}<011> to {223}<110> orientation group is desirably 4.0 or less. When more excellent hole expandability and small limited bendability are required, the above-described average value is desirably 3.0 or less.

On the other hand, when the above-described average value becomes less than 0.5, which is difficult to be achieved in a current general continuous hot rolling process, deterioration of the local deformability is concerned, so that the above-described average value is preferably 0.5 or more.

The {100}<011>, {116}<110>, {114}<110>, {113}<110>, {112}<110>, {335}<110>, and {223}<110> orientations are included in the {100}<011> to {223}<110> orientation group.

The pole density is synonymous with an X-ray random intensity ratio. The pole density (X-ray random intensity ratio) is a numerical value obtained by measuring X-ray intensities of a standard sample not having accumulation in a specific orientation and a test sample under the same conditions by X-ray diffractometry or the like and dividing the obtained X-ray intensity of the test sample by the X-ray intensity of the standard sample. This pole density is measured by using a device of X-ray diffraction, EBSD (Electron Back Scattering Diffraction), or the like. Further, it can be measured by an EBSP (Electron Back Scattering Pattern) method or an ECP (Electron Channeling Pattern) method. It may be obtained from a three-dimensional texture calculated by a vector method based on a pole figure of {110}, or may also be obtained from a three-dimensional texture calculated by a series expansion method using a plurality (preferably three or more) of pole figures out of pole figures of {110}, {100}, {211}, and {310}.

For example, for the pole density of each of the above-described crystal orientations, each of intensities of (001)[1-10], (116)[1-10], (114)[1-10], (113)[1-10], (112)[1-10], (335)[1-10], and (223)[1-10] at a $\phi 2=45°$ cross-section in the three-dimensional texture (ODF) may be used as it is.

The average value of the pole densities of the {100}<011> to {223}<110> orientation group is an arithmetic average of the pole densities of these orientations. When it is impossible to obtain all the intensities of these orientations, the arithmetic average of the pole densities of the respective orientations of {100}<011>, {116}<110>, {114}<110>, {112}<110>, and {223}<110> may also be used as a substitute.

Further, due to the similar reason, a pole density of the {332}<113> crystal orientation of a sheet plane at the sheet thickness center portion being the range of ⅝ to ⅜ in sheet thickness from the surface of the steel sheet has to be 4.0 or less. As long as it is 4.0 or less, it is possible to satisfy the sheet thickness/the bend radius ≥1.5 that is required to work a framework part to be required in recent years. It is desirably 3.0 or less.

When the pole density of the {332}<113> crystal orientation is greater than 4.0, the anisotropy of the mechanical properties of the steel sheet becomes strong extremely, and further the local deformability only in a certain direction is improved, but the material in a direction different from it deteriorates significantly, resulting in that it becomes impossible to securely satisfy the sheet thickness/the bend radius ≥1.5. On the other hand, when the pole density becomes less than 0.5, which is difficult to be achieved in a current general continuous hot rolling process, the deterioration of the local deformability is concerned, so that the pole density of the {332}<113> crystal orientation is preferably 0.5 or more.

The reason why the pole densities of the above-described crystal orientations are important for shape freezing property at the time of bending working is not necessarily obvious, but is inferentially related to slip behavior of crystal at the time of bending deformation.

The sample to be subjected to the X-ray diffraction is fabricated in such a manner that the steel sheet is reduced in thickness to a predetermined sheet thickness by mechanical polishing or the like, and next strain is removed by chemical polishing, electrolytic polishing, or the like, and in the range of ⅝ to ⅜ in sheet thickness from the surface of the steel sheet, an appropriate plane becomes a measuring plane. As a matter of course, the pole density satisfies the above-described pole density limited range not only at the sheet thickness center portion being the range of ⅝ to ⅜ in sheet thickness from the surface of the steel sheet, but also at as many thickness positions as possible, and thereby the uniform elongation and the hole expandability are further improved. However, the range of ⅝ to ⅜ from the surface of the steel sheet is measured, to thereby make it possible to represent the material property of the entire steel sheet generally. Thus, ⅝ to ⅜ of the sheet thickness is prescribed as the measuring range.

Incidentally, the crystal orientation represented by {hkl}<uvw> means that the normal direction of the steel sheet plane is parallel to <hkl> and the rolling direction is parallel to <uvw>. With regard to the crystal orientation, normally, the orientation vertical to the sheet plane is represented by [hkl] or {hkl} and the orientation parallel to the rolling direction is represented by (uvw) or <uvw>. {hkl} and <uvw> are generic terms for equivalent planes, and [hkl] and (uvw) each indicate an individual crystal plane. That is, in the present invention, a body-centered cubic structure is targeted, and thus, for example, the (111), (−111), (1-11), (11-1), (−1-11), (−11-1), (1-1-1), and (−1-1-1) planes are equivalent to make it impossible to make them different. In such a case, these orientations are generically referred to as {111}. In an ODF representation, [hkl](uvw) is also used for representing orientations of other low symmetric crystal structures, and thus it is general to represent each orientation as [hkl](uvw), but in the present invention, [hkl](uvw) and {hkl}<uvw> are synonymous with each other. The measurement of crystal orientation by an X ray is performed according to the method described in, for example, Cullity, Elements of X-ray Diffraction, new edition (published in 1986, translated by MATSUMURA, Gentaro, published by AGNE Inc.) on pages 274 to 296.

(r Value)

An r value (rC) in a direction perpendicular to the rolling direction is important in the present invention steel sheet. As a result of earnest examination, the present inventors found that good hole expandability and bendability cannot always be obtained even when the pole densities of the various crystal orientations are in the appropriate ranges. In order to obtain good hole expandability and bendability, the ranges of the above-described pole densities need to be satisfied, and at the same time, rC needs to be 0.70 or more. The upper limit of rC is not determined in particular, but if it is 1.10 or less, more excellent hole expandability can be obtained.

An r value (r30) in a direction 30° from the rolling direction is important in the present invention steel sheet. As a result of earnest examination, the present inventors found that good hole expandability and bendability cannot always be obtained even when the pole densities of the various crystal orientations are in the appropriate ranges. In order to obtain good hole expandability and bendability, the ranges of the above-described pole densities need to be satisfied, and at the same time, r30 needs to be 1.10 or less. The lower limit of r30 is not determined in particular, but if it is 0.70 or more, more excellent hole expandability can be obtained.

As a result of earnest examination, the present inventors found that if in addition to the pole densities of the various crystal orientations, rC, and r30, an r value (rL) in the rolling direction and an r value (r60) in a direction 60° from the rolling direction are rL≥0.70 and r60≤1.10 respectively, better hole expandability can be obtained.

The upper limits of rL and r60 are not determined in particular, but if rL is 1.00 or less and r60 is 0.90 or more, more excellent hole expandability can be obtained.

The above-described r values can be obtained by a tensile test using a JIS No. 5 tensile test piece. Tensile strain to be applied is normally 5 to 15% in the case of a high-strength steel sheet, and the r values may be evaluated in a range of the uniform elongation. Incidentally, the direction in which bending working is performed varies depending on parts to be worked, and thus it is not particularly limited, and in the case of the present invention steel sheet, the similar bendability can be obtained even when the present invention steel sheet is bent in any one of the directions.

Generally, a texture and the r values are correlated with each other, but in the present invention steel sheet, limitation on the pole densities of the crystal orientations and limitation on the r values are not synonymous with each other, and unless both the limitations are satisfied at the same time, good hole expandability cannot be obtained.

(Metal Structure)

Next, there will be explained limiting reasons related to a metal structure of the present invention steel sheet.

The structure of the present invention steel sheet contains 5 to 80% of ferrite in terms of an area ratio. Due to the existence of ferrite having excellent deformability, the uniform elongation improves, but when the area ratio is less than 5%, good uniform elongation cannot be obtained, so that the lower limit is set to 5%. On the other hand, when ferrite being greater than 80% in terms of an area ratio exists, the hole expandability deteriorates drastically, so that the upper limit is set to 80%.

Further, the present invention steel sheet contains 5 to 80% of bainite in terms of an area ratio. When the area ratio is less than 5%, strength decreases significantly, so that the lower limit is set to 5%. On the other hand, when bainite being greater than 80% exists, the hole expandability deteriorates significantly, so that the upper limit is set to 80%.

In the present invention steel sheet, as the balance, the total area ratio of 5% or less of martensite, pearlite, and retained austenite is allowed.

An interface between martensite and ferrite or bainite becomes a starting point of cracking to thus deteriorate the hole expandability, so that martensite is set to 1% or less.

Retained austenite is strain-induced transformed to be martensite. An interface between martensite and ferrite or bainite becomes a starting point of cracking, to thus deteriorate the hole expandability. Further, when a lot of pearlite exists, the strength and workability are sometimes impaired. Therefore, the total area ratio of martensite, pearlite, and retained austenite is set to 5% or less.

(Mean Volume Diameter of Crystal Grains)

In the present invention steel sheet, it is necessary to set a mean volume diameter of crystal grains in a grain unit to 7 μm or less. When crystal grains having a mean volume diameter of greater than 7 μm exist, the uniform elongation is low and further the hole expandability is also low, so that the mean volume diameter of the crystal grains is set to 7 μm or less.

Here, conventionally, the definition of crystal grains is extremely vague and quantification of them is difficult. In contrast to this, the present inventors found it possible to solve the problem of the quantification of crystal grains if a "grain unit" of crystal grains is determined in the following manner.

The "grain unit" of crystal grains determined in the present invention is determined in the following manner in an analysis of the orientations of the steel sheet by an EBSP (Electron Back Scattering Pattern). That is, in an analysis of the orientations of the steel sheet by an EBSP, for example, the orientations are measured at 1500 magnifications with a measured step of 0.5 μm or less, and a position at which a misorientation between adjacent measured points exceeds 15° is set to a boundary between crystal grains. Then, a region surrounded with this boundary is determined to be the "grain unit" of crystal grains.

With respect to the crystal grains of the grain unit determined in this manner, a circle-equivalent diameter d is obtained and the volume of the crystal grains of each grain unit is obtained by $4/3\pi d^3$. Then, a weighted mean of the volume is calculated and the mean volume diameter (Mean Volume Diameter) is obtained.

As there are more large crystal grains even though the number of them is small, deterioration of local ductility becomes larger. Therefore, the size of the crystal grains is not an ordinary size mean, and the mean volume diameter defined as a weighted mean of volume is strongly correlated with the local ductility. In order to obtain this effect, the mean volume diameter of the crystal grains needs to be 7 μm or less. It is desirably 5 μm or less in order to secure the hole expandability at a higher level. Incidentally, the method of measuring crystal grains is set as described previously.

(Equiaxial Property of Crystal Grains)

Further, as a result of earnest examination, the present inventors found that when a ratio of, of the crystal grains in the grain unit, a length dL in the rolling direction to a length dt in a sheet thickness direction: dL/dt is 3.0 or less, the hole expandability improves greatly. This physical meaning is not obvious, but it is conceivable that the shape of the crystal grains in the grain unit is similar to a sphere rather than an ellipsoid, and thus stress concentration in grain boundaries is alleviated and thus the hole expandability improves.

Further, as a result of earnest examination, the present inventors found that when an average value of the ratio of the length dL in the rolling direction to the length dt in the sheet thickness direction: dL/dt is 3.0 or less, good hole expandability can be obtained. When the average value of the ratio of the length dL in the rolling direction to the length dt in the sheet thickness direction: dL/dt is greater than 3.0, the hole expandability deteriorates.

(Chemical Composition)

Next, there will be explained reasons for limiting a chemical composition of the present invention steel sheet. Incidentally, % according to the chemical composition means mass %.

C: 0.01 to 0.4%

C is an element effective for improving mechanical strength, so that 0.01% or more is added. It is preferably 0.03% or more, and is more preferably 0.05% or more. On the other hand, when it exceeds 0.4%, the workability and weldability deteriorate, so that the upper limit is set to 0.4%. It is preferably 0.3% or less, and is more preferably 0.25% or less.

Si: 0.001 to 2.5%

Si is an element effective for improving the mechanical strength. However, when Si becomes greater than 2.5%, the workability deteriorates and further a surface flaw occurs, so that 2.5% is set to the upper limit. On the other hand, it is difficult to decrease Si to less than 0.001% in a practical steel, so that 0.001% is set to the lower limit.

Mn: 0.001 to 4.0%

Mn is also an element effective for improving the mechanical strength, but when Mn becomes greater than 4.0%, the workability deteriorates, so that 4.0% is set to the upper limit. It is preferably 3.0% or less. On the other hand, it is difficult to decrease Mn to less than 0.001% in a practical steel, so that 0.001% is set to the lower limit. When elements such as Ti that suppress occurrence of hot cracking caused by S are not sufficiently added except Mn, Mn satisfying Mn/S≥20 in mass % is desirably added.

P: 0.001 to 0.15%

The upper limit of P is set to 0.15% in order to prevent the deterioration of the workability and cracking at the time of hot rolling or cold rolling. It is preferably 0.04% or less. The lower limit is set to 0.001% applicable in current general refining (including secondary refining).

S: 0.0005 to 0.03%

The upper limit of S is set to 0.03% in order to prevent deterioration of the workability and cracking at the time of hot rolling or cold rolling. It is preferably 0.01% or less. The lower limit is set to 0.0005% applicable in current general refining (including secondary refining).

Al: 0.001 to 2.0%

For deoxidation, 0.001% or more of Al is added. Further, Al significantly increases a γ to α transformation point, to thus be an effective element when hot rolling at an $Ar_3$ point or lower is directed in particular, but when it is too much, the weldability deteriorates, so that the upper limit is set to 2.0%.

N and O: 0.0005 to 0.01%

N and O are impurities, and both elements are set to 0.01% or less in order to prevent the workability from deteriorating. The lower limits are each set to 0.0005% applicable in current general refining (including secondary refining).

Si+Al: less than 1.0%

When Si and Al are contained excessively in the present invention steel sheet, precipitation of cementite during an overaging treatment is suppressed and the fraction of retained austenite becomes too large, so that the total added amount of Si and Al is set to less than 1%.

In the present invention steel sheet, one type or two or more types of Ti, Nb, B, Mg, Rem, Ca, Mo, Cr, V, W, Zr, Cu, Ni, As, Co, Sn, Pb, Y, and Hf, being elements that have been used up to now may be contained in order to improve the hole expandability by controlling inclusions to make precipitates fine.

Ti, Nb, and B are elements to improve the material through mechanisms of fixation of carbon and nitrogen, precipitation strengthening, structure control, fine grain strengthening, and the like, so that according to needs, 0.001% or of Ti is added, 0.001% or more of Nb is added, and 0.0001% or more of B is added. Ti is preferably 0.01% or more, and Nb is preferably 0.005% or more.

However, even when they are added excessively, no significant effect is obtained, and the workability and manufacturability deteriorate instead, so that the upper limit of Ti is set to 0.2%, the upper limit of Nb is set to 0.2%, and the upper limit of B is set to 0.005%. B is preferably 0.003% or less.

Mg, Rem, and Ca are elements to make inclusions harmless, so that the lower limit of each of them is set to 0.0001%. Mg is preferably 0.0005% or more, Rem is preferably 0.001% or more, and Ca is preferably 0.0005% or more. On the other hand, when they are added excessively, cleanliness of the steel deteriorates, so that the upper limit of Mg is set to 0.01%, the upper limit of Rem is set to 0.1%, and the upper limit of Ca is set to 0.01%. Ca is preferably 0.01% or less.

Mo, Cr, Ni, W, Zr, and As are elements effective for increasing the mechanical strength and improving the material, so that according to need, 0.001% or more of Mo is added, 0.001% or more of Cr is added, 0.001% or more of Ni is added, 0.001% or more W is added, 0.0001% or more of Zr is added, and 0.0001% or more of As is added. Mo is preferably 0.01% or more, Cr is preferably 0.01% or more, Ni is preferably 0.05% or more, and W is preferably 0.01% or more.

However, when they are added excessively, the workability is deteriorated by contraries, so that the upper limit of Mo is set to 1.0%, the upper limit of Cr is set to 2.0%, the upper limit of Ni is set to 2.0%, the upper limit of W is set to 1.0%, the upper limit of Zr is set to 0.2%, and the upper limit of As is set to 0.5%. Zr is preferably 0.05% or less.

V and Cu, similarly to Nb and Ti, are elements effective for precipitation strengthening, and are elements causing less deterioration of the local deformability ascribable to strengthening by addition than Nb and Ti, so that V and Cu are elements more effective than Nb and Ti when high strength and better hole expandability are required. Therefore, the lower limits of V and Cu are both set to 0.001%. They are each preferably 0.01% or more.

However, when they are added excessively, the workability deteriorates, so that the upper limit of V is set to 1.0% and the upper limit of Cu is set to 2.0%. V is preferably 0.5% or less.

Co significantly increases the $\gamma$ to $\alpha$ transformation point, to thus be an effective element when hot rolling at the $Ar_3$ point or lower is directed in particular. In order to obtain an addition effect, 0.0001% or more is added. It is preferably 0.001% or more. However, when it is added excessively, the weldability deteriorates, so that the upper limit is set to 1.0%. It is preferably 0.1% or less.

Sn and Pb are elements effective for improving wettability and adhesiveness of galvanizing, so that 0.0001% or more of Sn is added and 0.001% or more of Pb is added. Sn is preferably 0.001% or more. However, when they are added excessively, a flaw is likely to occur at the time of manufacture, and further toughness decreases, so that the upper limit of Sn is set to 0.2% and the upper limit of Pb is set to 0.1%. Sn is preferably 0.1% or less.

Y and Hf are elements effective for improving corrosion resistance. When the elements are each less than 0.001%, an addition effect is not obtained, so that the lower limits of them are set to 0.001%. On the other hand, when they each exceed 0.10%, the hole expandability deteriorates, so that the upper limit of each of the elements is set to 0.10%.

(Manufacturing Method)

Next, there will be explained a manufacturing method of the present invention steel sheet, (which will be sometimes called a "present invention manufacturing method" hereinafter). In order to achieve excellent uniform elongation and hole expandability, it is important to form a texture that is random in terms of pole densities and to control conditions of structural fractions of ferrite and bainite and form dispersion. Hereinafter, details will be explained.

A manufacturing method prior to hot rolling is not limited in particular. That is, subsequently to melting by a shaft furnace, an electric furnace, or the like, secondary refining may be variously performed, and then casting may be performed by normal continuous casting, or by an ingot method, or further by thin slab casting, or the like. In the case of a continuous cast slab, it is possible that a continuous cast slab is once cooled down to low temperature and thereafter is reheated to then be subjected to hot rolling, or it is also possible that a continuous cast slab is subjected to hot rolling continuously after casting. Incidentally, a scrap may also be used for a raw material of the steel.

(First Hot Rolling)

A slab extracted from a heating furnace is subjected to a rough rolling process being first hot rolling to be rough rolled, and thereby a rough bar is obtained. The present invention steel sheet needs to satisfy the following requirements. First, an austenite grain diameter after the rough rolling, namely an austenite grain diameter before finish rolling is important. The austenite grain diameter before the finish rolling is desirably small, and the austenite grain diameter of 200 μm or less greatly contributes to making crystal grains fine and homogenization of crystal grains, thereby making it possible to finely and uniformly disperse martensite to be formed in a process later.

In order to obtain the austenite grain diameter of 200 μm or less before the finish rolling, it is necessary to perform rolling at a reduction ratio of 40% or more one time or more in the rough rolling in a temperature region of 1000 to 1200° C.

The austenite grain diameter before the finish rolling is desirably 100 μm or less, and in order to obtain this grain diameter, rolling at 40% or more is performed two times or more. However, when in the rough rolling, the reduction is greater than 70% or rolling is performed greater than 10 times, there is a concern that the rolling temperature decreases or a scale is generated excessively.

In this manner, when the austenite grain diameter before the finish rolling is set to 200 μm or less, recrystallization of austenite is promoted in the finish rolling, and through the formation of the texture and uniformalization of the grain unit, uniform elongation and hole expandability of a final product are improved.

It is supposed that this is because an austenite grain boundary after the rough rolling (namely before the finish rolling) functions as one of recrystallization nuclei during the finish rolling. The austenite grain diameter after the rough rolling is confirmed in a manner that a steel sheet piece before being subjected to the finish rolling is quenched as much as possible, (which is cooled at 10° C./second or more, for example), and a cross section of the steel sheet piece is etched to make austenite grain boundaries appear, and the austenite grain boundaries are observed by an optical microscope. On this occasion, at 50 or more magnifications, the austenite grain diameter of 20 visual fields or more is measured by image analysis or a point counting method.

(Second Hot Rolling)

After the rough rolling process (first hot rolling) is completed, a finish rolling process being second hot rolling is started. The time between the completion of the rough rolling process and the start of the finish rolling process is desirably set to 150 seconds or shorter.

In the finish rolling process (second hot rolling), a finish rolling start temperature is desirably set to 1000° C. or higher. When the finish rolling start temperature is lower than 1000° C., at each finish rolling pass, the temperature of the rolling to be applied to the rough bar to be rolled is decreased, the reduction is performed in a non-recrystallization temperature region, the texture develops, and thus the isotropy deteriorates.

Incidentally, the upper limit of the finish rolling start temperature is not limited in particular. However, when it is 1150° C. or higher, a blister to be the starting point of a scaly spindle-shaped scale defect is likely to occur between a steel sheet base iron and a surface scale before the finish rolling and between passes, and thus the finish rolling start temperature is desirably lower than 1150° C.

In the finish rolling, a temperature determined by the chemical composition of the steel sheet is set to T1, and in a temperature region of not lower than T1+30° C. nor higher than T1+200° C., the rolling at 30% or more is performed in one pass at least one time. Further, in the finish rolling, the total reduction ratio is set to 50% or more. By satisfying this condition, at the sheet thickness center portion being the range of ⅝ to ⅜ in sheet thickness from the surface of the steel sheet, the average value of the pole densities of the {100}<011> to {223}<110> orientation group becomes 5.0 or less and the pole density of the {332}<113> crystal orientation becomes 4.0 or less. This makes it possible to secure the uniform elongation and the hole expandability of the final product.

Here, T1 is the temperature calculated by Expression (1) below.

$$T1(°\ C.)=850+10\times(C+N)\times Mn+350\times Nb+250\times Ti+40\times B+10\times Cr+100\times Mo+100\times V \quad (1)$$

C, N, Mn, Nb, Ti, B, Cr, Mo, and V each represent the content of the element (mass %).

Heavy reduction in the temperature region of not lower than T1+30° C. nor higher than T1+200° C. and light reduction at lower than T1+30° C. thereafter control the average value of the pole densities of the {100}<011> to {223}<110> orientation group and the pole density of the {332}<113> crystal orientation at the sheet thickness center portion being the range of ⅝ to ⅜ in sheet thickness from the surface of the steel sheet, and thereby the uniform elongation and the hole expandability of the final product are improved drastically, as shown in Examples to be described later.

This T1 temperature itself is obtained empirically. The present inventors learned empirically by experiments that the recrystallization in an austenite region of each steel is promoted on the basis of the T1 temperature. In order to obtain better uniform elongation and hole expandability, it is important to accumulate strain by the heavy reduction, and the total reduction ratio of 50% or more is essential in the finish rolling. Further, it is desired to take reduction at 70% or more, and on the other hand, if the reduction ratio greater than 90% is taken, securing temperature and excessive rolling load are as a result added.

When the total reduction ratio in the temperature region of not lower than T1+30° C. nor higher than T1+200° C. is less than 50%, rolling strain to be accumulated during the hot rolling is not sufficient and the recrystallization of austenite does not advance sufficiently. Therefore, the texture develops and the isotropy deteriorates. When the total reduction ratio is 70% or more, the sufficient isotropy can be obtained even though variations ascribable to temperature fluctuation or the like are considered. On the other hand, when the total reduction ratio exceeds 90%, it becomes difficult to obtain the temperature region of T1+200° C. or lower due to heat generation by working, and further a rolling load increases to cause a risk that the rolling becomes difficult to be performed.

In the finish rolling, in order to promote the uniform recrystallization caused by releasing the accumulated strain, the rolling at 30% or more is performed in one pass at least one time at not lower than T1+30° C. nor higher than T1+200° C.

Incidentally, in order to promote the uniform recrystallization, it is necessary to suppress a working amount in a temperature region of lower than T1+30° C. as small as possible. In order to achieve it, the reduction ratio at lower than T1+30° C. is desirably 30% or less. In terms of sheet thickness accuracy and sheet shape, the reduction ratio of 10% or less is desirable. When the isotropy is further obtained, the reduction ratio in the temperature region of lower than T1+30° C. is desirably 0%.

The finish rolling is desirably finished at T1+30° C. or higher. In the hot rolling at lower than T1+30° C., the granulated austenite grains that are recrystallized once are elongated, thereby causing a risk that the isotropy deteriorates.

That is, in the manufacturing method of the present invention, in the finish rolling, by recrystallizing austenite uniformly and finely, the texture of the product is controlled and the uniform elongation and the hole expandability are improved.

A rolling ratio can be obtained by actual performances or calculation from the rolling load, sheet thickness measurement, or/and the like. The temperature can be actually measured by a thermometer between stands, or can be obtained by calculation simulation considering the heat generation by working from a line speed, the reduction ratio, or/and like. Thereby, it is possible to easily confirm whether or not the rolling prescribed in the present invention is performed.

When the hot rolling is finished at $Ar_3$ or lower, the hot rolling becomes two-phase region rolling of austenite and ferrite, and accumulation to the {100}<011> to {223}<110> orientation group becomes strong. As a result, the uniform elongation and the hole expandability deteriorate significantly.

In order to make the crystal grains fine and suppress elongated grains, a maximum working heat generation amount at the time of the reduction at not lower than T1+30° C. nor higher than T1+200° C., namely a temperature increased margin by the reduction is desirably suppressed to 18° C. or less. For achieving this, inter-stand cooling or the like is desirably applied.

(Pre-Cold Rolling Primary Cooling)

After final reduction at a reduction ratio of 30% or more is performed in the finish rolling, pre-cold rolling primary cooling is started in such a manner that a waiting time t second satisfies Expression (2) below.

$$t \leq 2.5 \times t1 \quad (2)$$

Here, t1 is obtained by Expression (3) below.

$$t1 = 0.001 \times ((Tf - T1) \times P1/100)^2 - 0.109 \times ((Tf - T1) \times P1/100) + 3.1 \quad (3)$$

Here, in Expression (3) above, Tf represents the temperature of a steel billet obtained after the final reduction at a reduction ratio of 30% or more, and P1 represents the reduction ratio of the final reduction at 30% or more.

Incidentally, the "final reduction at a reduction ratio of 30% or more" indicates the rolling performed finally among the rollings whose reduction ratio becomes 30% or more out of the rollings in a plurality of passes performed in the finish rolling. For example, when among the rollings in a plurality of passes performed in the finish rolling, the reduction ratio of the rolling performed at the final stage is 30% or more, the rolling performed at the final stage is the "final reduction at a reduction ratio of 30% or more." Further, when among the rollings in a plurality of passes performed in the finish rolling, the reduction ratio of the rolling performed prior to the final stage is 30% or more and after the rolling performed prior to the final stage (rolling at a reduction ratio of 30% or more) is performed, the rolling whose reduction ratio becomes 30% or more is not performed, the rolling performed prior to the final stage (rolling at a reduction ratio of 30% or more) is the "final reduction at a reduction ratio of 30% or more."

In the finish rolling, the waiting time t second until the pre-cold rolling primary cooling is started after the final reduction at a reduction ratio of 30% or more is performed greatly affects the austenite grain diameter. That is, it greatly affects an equiaxed grain fraction and a coarse grain area ratio of the steel sheet.

When the waiting time t exceeds t1×2.5, the recrystallization is already almost completed, but the crystal grains grow significantly and grain coarsening advances, and thereby the r values and the elongation are decreased.

The waiting time t second further satisfies Expression (2a) below, thereby making it possible to preferentially suppress the growth of the crystal grains. Consequently, even though the recrystallization does not advance sufficiently, it is possible to sufficiently improve the elongation of the steel sheet and to improve fatigue property simultaneously.

$$t < t1 \quad (2a)$$

At the same time, the waiting time t second further satisfies Expression (2b) below, and thereby the recrystallization advances sufficiently and the crystal orientations are randomized. Therefore, it is possible to sufficiently improve the elongation of the steel sheet and to greatly improve the isotropy simultaneously.

$$t1 \leq t \leq t1 \times 2.5 \quad (2b)$$

Here, as shown in FIG. 1, on a continuous hot rolling line 1, the steel billet (slab) heated to a predetermined temperature in the heating furnace is rolled in a roughing mill 2 and in a finishing mill 3 sequentially to be a hot-rolled steel sheet 4 having a predetermined thickness, and the hot-rolled steel sheet 4 is carried out onto a run-out-table 5. In the manufacturing method of the present invention, in the rough rolling process (first hot rolling) performed in the roughing mill 2, the rolling at a reduction ratio of 20% or more is performed on the steel billet (slab) one time or more in the temperature range of not lower than 1000° C. nor higher than 1200° C.

The rough bar rolled to a predetermined thickness in the roughing mill 2 in this manner is next finish rolled (is subjected to the second hot rolling) through a plurality of rolling stands 6 of the finishing mill 3 to be the hot-rolled steel sheet 4. Then, in the finishing mill 3, the rolling at 30% or more is performed in one pass at least one time in the temperature region of not lower than the temperature T1+30° C. nor higher than T1+200° C. Further, in the finishing mill 3, the total reduction ratio becomes 50% or more.

Further, in the finish rolling process, after the final reduction at a reduction ratio of 30% or more is performed, the pre-cold rolling primary cooling is started in such a manner that the waiting time t second satisfies Expression (2) above or either Expression (2a) or (2b) above. The start of this pre-cold rolling primary cooling is performed by inter-stand cooling nozzles 10 disposed between the respective two of the rolling stands 6 of the finishing mill 3, or cooling nozzles 11 disposed in the run-out-table 5.

For example, when the final reduction at a reduction ratio of 30% or more is performed only at the rolling stand 6 disposed at the front stage of the finishing mill 3 (on the left side in FIG. 1, on the upstream side of the rolling) and the rolling whose reduction ratio becomes 30% or more is not performed at the rolling stand 6 disposed at the rear stage of the finishing mill 3 (on the right side in FIG. 1, on the downstream side of the rolling), if the start of the pre-cold rolling primary cooling is performed by the cooling nozzles 11 disposed in the run-out-table 5, a case that the waiting time t second does not satisfy Expression (2) above or Expressions (2a) and (2b) above is sometimes caused. In such a case, the pre-cold rolling primary cooling is started by the inter-stand cooling nozzles 10 disposed between the respective two of the rolling stands 6 of the finishing mill 3.

Further, for example, when the final reduction at a reduction ratio of 30% or more is performed at the rolling stand 6 disposed at the rear stage of the finishing mill 3 (on the right side in FIG. 1, on the downstream side of the rolling), even though the start of the pre-cold rolling primary cooling is performed by the cooling nozzles 11 disposed in the run-out-table 5, there is sometimes a case that the waiting time t second can satisfy Expression (2) above or Expressions (2a) and (2b) above. In such a case, the pre-cold rolling primary cooling may also be started by the cooling nozzles 11 disposed in the run-out-table 5. Needless to say, as long as the performance of the final reduction at a reduction ratio of 30% or more is completed, the pre-cold rolling primary cooling may also be started by the inter-stand cooling nozzles 10 disposed between the respective two of the rolling stands 6 of the finishing mill 3.

Then, in this pre-cold rolling primary cooling, the cooling that at an average cooling rate of 50° C./second or more, a temperature change (temperature drop) becomes not less than 40° C. nor more than 140° C. is performed.

When the temperature change is less than 40° C., the recrystallized austenite grains grow and low-temperature toughness deteriorates. The temperature change is set to 40° C. or more, thereby making it possible to suppress coarsening of the austenite grains. When the temperature change is less than 40° C., the effect cannot be obtained. On the other hand, when the temperature change exceeds 140° C., the recrystallization becomes insufficient to make it difficult to obtain a targeted random texture. Further, a ferrite phase effective for the elongation is also not obtained easily and the hardness of a ferrite phase becomes high, and thereby the uniform elongation and the hole expandability also deteriorate. Further, when the temperature change is greater than 140° C., an overshoot to/beyond an Ar3 transformation point temperature is likely to be caused. In the case, even by the transformation from recrystallized austenite, as a result of sharpening of variant selection, the texture is formed and the isotropy decreases consequently.

When the average cooling rate in the pre-cold rolling primary cooling is less than 50° C./second, as expected, the recrystallized austenite grains grow and the low-temperature toughness deteriorates. The upper limit of the average cooling rate is not determined in particular, but in terms of the steel sheet shape, 200° C./second or less is considered to be proper.

Further, in order to suppress the grain growth and obtain more excellent low-temperature toughness, a cooling device between passes or the like is desirably used to bring the heat generation by working between the respective stands of the finish rolling to 18° C. or lower.

The rolling ratio (reduction ratio) can be obtained by actual performances or calculation from the rolling load, sheet thickness measurement, or/and the like. The temperature of the steel billet during the rolling can be actually measured by a thermometer being disposed between the stands, or can be obtained by simulation by considering the heat generation by working from a line speed, the reduction ratio, or/and like, or can be obtained by the both methods.

Further, as has been explained previously, in order to promote the uniform recrystallization, the working amount in the temperature region of lower than T1+30° C. is desirably as small as possible and the reduction ratio in the temperature region of lower than T1+30° C. is desirably 30% or less. For example, in the event that in the finishing mill 3 on the continuous hot rolling line 1 shown in FIG. 1, in passing through one or two or more of the rolling stands 6 disposed on the front stage side (on the left side in FIG. 6, on the upstream side of the rolling), the steel sheet is in the temperature region of not lower than T1+30° C. nor higher than T1+200° C., and in passing through one or two or more of the rolling stands 6 disposed on the subsequent rear stage side (on the right side in FIG. 6, on the downstream side of the rolling), the steel sheet is in the temperature region of lower than T1+30° C., when the steel sheet passes through one or two or more of the rolling stands 6 disposed on the subsequent rear stage side (on the right side in FIG. 1, on the downstream side of the rolling), even though the reduction is not performed or is performed, the reduction ratio at lower than T1+30° C. is desirably 30% or less in total. In terms of the sheet thickness accuracy and the sheet shape, the reduction ratio at lower than T1+30° C. is desirably a reduction ratio of 10% or less in total. When the isotropy is further obtained, the reduction ratio in the temperature region of lower than T1+30° C. is desirably 0%.

In the present invention manufacturing method, a rolling speed is not limited in particular. However, when the rolling speed on the final stand side of the finish rolling is less than 400 mpm, γ grains grow to be coarse, regions in which ferrite can precipitate for obtaining the ductility are decreased, and thus the ductility is likely to deteriorate. Even though the upper limit of the rolling speed is not limited in particular, the effect of the present invention can be obtained, but it is actual that the rolling speed is 1800 mpm or less due to facility restriction. Therefore, in the finish rolling process, the rolling speed is desirably not less than 400 mpm nor more than 1800 mpm.

(Pre-Cold Rolling Secondary Cooling)

In the present invention manufacturing method, it is preferred that after the pre-cold rolling primary cooling, pre-cold rolling secondary cooling should be performed to control the structure. The pattern of the pre-cold rolling secondary cooling is also important.

The pre-cold rolling secondary cooling is desirably performed within three seconds after the pre-cold rolling primary cooling. When the time to the start of the pre-cold rolling secondary cooling after the pre-cold rolling primary cooling exceeds three seconds, the austenite grains become coarse and the strength and the elongation decrease.

In the pre-cold rolling secondary cooling, the cooling is performed down to a cooling stop temperature of 600° C. or lower at an average cooling rate of 10 to 300° C./second. When the stop temperature of this pre-cold rolling secondary cooling is higher than 600° C. and the average cooling rate of the pre-cold rolling secondary cooling is less than 10° C./second, there is a possibility that surface oxidation advances and the surface of the steel sheet deteriorates. When the average cooling rate exceeds 300° C./second, martensite transformation is promoted to drastically increase the strength, resulting in that subsequent cold rolling becomes difficult to be performed.

(Coiling)

After being obtained in this manner, the hot-rolled steel sheet can be coiled at 600° C. or lower. When a coiling temperature exceeds 600° C., the area ratio of ferrite structure increases and the area ratio of bainite does not become 5% or more. In order to bring the area ratio of bainite to 5% or more, the coiling temperature is preferably set to 600° C. or lower.

(Cold Rolling)

A hot-rolled original sheet manufactured as described above is pickled according to need to be subjected to cold rolling at a reduction ratio of not less than 30% nor more than 70%. When the reduction ratio is 30% or less, it becomes difficult to cause recrystallization in heating and holding later, resulting in that the equiaxed grain fraction decreases and further the crystal grains after heating become coarse. When rolling at over 70% is performed, a texture at the time of heating is developed, and thus the anisotropy becomes strong. Therefore, the reduction ratio is set to 70% or less.

(Heating and Holding)

The steel sheet that has been subjected to the cold rolling (a cold-rolled steel sheet) is thereafter heated up to a temperature region of 700 to 900° C. and is held for not shorter than 1 second nor longer than 1000 seconds in the temperature region of 700 to 900° C. By this heating and holding, work hardening is removed. When the steel sheet after the cold rolling is heated up to the temperature region of 700 to 900° C. in this manner, an average heating rate of not lower than room temperature nor higher than 650° C. is set to HR1 (° C./second) expressed by Expression (5) below, and an average heating rate of higher than 650° C. to the temperature region of 700 to 900° C. is set to HR2 (° C./second) expressed by Expression (6) below.

$$HR1 \geq 0.3 \quad (5)$$

$$HR2 \leq 0.5 \times HR1 \quad (6)$$

The hot rolling is performed under the above-described condition, and further post-hot rolling primary cooling is performed, and thereby making the crystal grains fine and randomization of the crystal orientations are achieved. However, by the cold rolling performed thereafter, the strong texture develops and the texture becomes likely to remain in the steel sheet. As a result, the r values and the elongation of the steel sheet decrease and the isotropy decreases. Thus, it is desired to make the texture that has developed by the cold rolling disappear as much as possible by appropriately performing the heating to be performed after the cold rolling. In order to achieve it, it is necessary to divide the average heating rate of the heating into two stages expressed by Expressions (5) and (6) above.

The detailed reason why the texture and properties of the steel sheet are improved by this two-stage heating is unclear, but this effect is thought to be related to recovery of dislocation introduced at the time of the cold rolling and the recrystallization. That is, driving force of the recrystallization to occur in the steel sheet by the heating is strain accumulated in the steel sheet by the cold rolling. When the average heating rate HR1 in the temperature range of not lower than room temperature nor higher than 650° C. is small, the dislocation introduced by the cold rolling recovers and the recrystallization does not occur. As a result, the texture that has developed at the time of the cold rolling remains as it is and the properties such as the isotropy deteriorate. When the average heating rate HR1 in the temperature range of not lower than room temperature nor higher than 650° C. is less than 0.3° C./second, the dislocation introduced by the cold rolling recovers, resulting in that the strong texture formed at the time of the cold rolling remains. Therefore, it is necessary to set the average heating rate HR1 in the temperature range of not lower than room temperature nor higher than 650° C. to 0.3 (° C./second) or more.

On the other hand, when the average heating rate HR2 of higher than 650° C. to the temperature region of 700 to 900° C. is large, ferrite existing in the steel sheet after the cold rolling does not recrystallize and non-recrystallized ferrite in a state of being worked remains. When the steel containing C of 0.01% or more in particular is heated to a two-phase region of ferrite and austenite, formed austenite blocks growth of recrystallized ferrite, and thus non-recrystallized ferrite becomes more likely to remain. This non-recrystallized ferrite has a strong texture, to thus adversely affect the properties such as the r values and the isotropy, and this non-recrystallized ferrite contains a lot of dislocations, to thus deteriorate the ductility drastically. Therefore, in the temperature range of higher than 650° C. to the temperature region of 700 to 900° C., the average heating rate HR2 needs to be 0.5×HR1 (° C./second) or less.

Further, when a heating temperature is lower than 700° C. or a holding time in the temperature region of 700 to 900° C. is shorter than one second, reverse transformation from ferrite does not advance sufficiently and in subsequent cooling, a bainite phase cannot be obtained, resulting in that sufficient strength cannot be obtained. On the other hand, when the heating temperature is higher than 900° C. or the holding time in the temperature region of 700 to 900° C. is longer than 1000 seconds, the crystal grains become coarse and the area ratio of the crystal grains each having a grain diameter of 200 μm or more increases.

(Post-Cold-Rolling Primary Cooling)

After the heating and holding, post-cold rolling primary cooling is performed down to a temperature region of 580 to 750° C. at an average cooling rate of 12° C./second or less. When a finishing temperature of the post-cold rolling primary cooling exceeds 750° C., ferrite transformation is promoted to make it impossible to obtain 5% or more of bainite in terms of an area ratio. When the average cooling rate of this post-cold rolling primary cooling exceeds 12° C./second and the finishing temperature of the post-cold rolling primary cooling is lower than 580° C., the grain growth of ferrite does not advance sufficiently to make it impossible to obtain 5% or more of ferrite in terms of an area ratio.

(Post-Cold Rolling Secondary Cooling)

After the post-cold rolling primary cooling, post-cold rolling secondary cooling is performed down to a temperature region of 350 to 500° C. at an average cooling rate of 4 to 300° C./second. When the average cooling rate of the post-cold rolling secondary cooling is less than 4° C./second or the post-cold rolling secondary cooling is finished at a temperature of higher than 500° C., pearlite transformation advances excessively to create a possibility that 5% or more of bainite cannot be obtained finally in terms of an area ratio. Further, when the average cooling rate of the post-cold rolling secondary cooling is greater than 300° C./second or the post-cold rolling secondary cooling is finished at a temperature of lower than 350° C., martensite transformation advances and there is a risk that the area ratio of martensite becomes greater than 1%.

(Overaging Heat Treatment)

Subsequently to the post-cold rolling secondary cooling, an overaging heat treatment is performed in a temperature range of not lower than 350° C. nor higher than 500° C. A holding time in this temperature range is set to t2 seconds satisfying Expression (4) below according to an overaging treatment temperature T2 or longer. However, in consideration of an applicable temperature range of Expression (4), the maximum value of t2 is set to 400 seconds.

$$\log(t2) = 0.0002(T2-425)^2 + 1.18 \quad (4)$$

Incidentally, in this overaging heat treatment, the holding does not mean only isothermal holding, and it is sufficient if the steel sheet is retained in the temperature range of not lower than 350° C. nor higher than 500° C. For example, the steel sheet may be once cooled to 350° C. to then be heated up to 500° C., or the steel sheet may also be cooled to 500° C. to then be cooled down to 350° C.

Incidentally, even when a surface treatment is performed on the high-strength cold-rolled steel sheet of the present invention, the effect of improving the hole expandability does not disappear, and for example, a hot-dip galvanized layer, or an alloyed hot-dip galvanized layer may be formed on the surface of the steel sheet. In this case, the effect of the present invention can be obtained even when any one of electroplating, hot dipping, deposition plating, organic coating film forming, film laminating, organic salts/inorganic salts treatment, non-chromium treatment, and so on is performed. Further, the steel sheet according to the present invention can be applied not only to bulging forming but also to combined forming mainly composed of bending working such as bending, bulging, and drawing.

When hot-dip galvanizing is performed on the present invention steel sheet, an alloying treatment may be performed after the galvanizing. The alloying treatment is performed in a temperature region of 450 to 600° C. When an alloying treatment temperature is lower than 450° C., the alloying does not advance sufficiently, and when it exceeds 600° C., on the other hand, the alloying advances too much and corrosion resistance deteriorates. Therefore, the alloying treatment is performed in the temperature region of 450 to 600° C.

Example

Next, examples of the present invention will be explained. Incidentally, conditions of the examples are condition examples employed for confirming the applicability and effects of the present invention, and the present invention is not limited to these condition examples. The present invention can employ various conditions as long as the object of the present invention is achieved without departing from the spirit of the invention. Chemical compositions of respective steels used in examples are shown in Table 1. Respective manufacturing conditions are shown in Tables 2 and 3. Further, structural constitutions and mechanical properties of respective steel types under the manufacturing conditions in Tables 2 and 3 are shown in Tables 4 and 5. Incidentally, each underline in Tables indicates that a numeral value is outside the range of the present invention or is outside the range of a preferred range of the present invention. Further, in Table 2 to Table 5, English letters A to T and English letters a to i that are added to the steel types indicate to be components of Steels A to T and a to i in Table 1 respectively.

There will be explained results of examinations using invention steels "A to T" and using comparative steels "a to h," which have the chemical compositions shown in Table 1. Incidentally, in Table 1, each numerical value of the chemical compositions means mass %.

These steels were cast and then as they were, or were heated to a temperature region of 1000 to 1300° C. after once being cooled down to room temperature, and thereafter were subjected to hot rolling, cold rolling, and cooling under the conditions shown in Table 2 and Table 3.

In the hot rolling, first, in rough rolling being first hot rolling, rolling was performed one time or more at a reduction ratio of 40% or more in a temperature region of not lower than 1000° C. nor higher than 1200° C. However, with respect to Steel types A3, E3, and M2, in the rough rolling, the rolling at a reduction ratio of 40% or more in one pass was not performed. The number of times of reduction at a reduction ratio of 40% or more and each reduction ratio (%) in the rough rolling, and an austenite grain diameter (μm) after the rough rolling (before finish rolling) are shown in Table 2. Incidentally, a temperature T1 (° C.) and a temperature Ac1 (° C.) of the respective steel types are shown in Table 2.

After the rough rolling was finished, the finish rolling being second hot rolling was performed. In the finish rolling, rolling at a reduction ratio of 30% or more was performed in one pass at least one time in a temperature region of not lower than T1+30° C. nor higher than T1+200° C., and in a temperature range of lower than T1+30° C., the total reduction ratio was set to 30% or less. Incidentally, in the finish rolling, rolling at a reduction ratio of 30% or more in one pass was performed in a final pass in the temperature region of not lower than T1+30° C. nor higher than T1+200° C.

However, with respect to Steel types A4, A5, A6, and B3, the rolling at a reduction ratio of 30% or more was not performed in the temperature region of not lower than T1+30° C. nor higher than T1+200° C. Further, with regard to Steel types P2 and P3, the total reduction ratio in the temperature range of lower than T1+30° C. was greater than 30%.

Further, in the finish rolling, the total reduction ratio was set to 50% or more. However, with regard to Steel types A4, A5, A6, B3, and C3, the total reduction ratio in the temperature region of not lower than T1+30° C. nor higher than T1+200° C. was less than 50%.

Table 2 shows, in the finish rolling, the reduction ratio (%) in the final pass in the temperature region of not lower than T1+30° C. nor higher than T1+200° C. and the reduction ratio in a pass at one stage earlier than the final pass (reduction ratio in a pass before the final) (%). Further, Table 2 shows, in the finish rolling, the total reduction ratio (%) in the temperature region of not lower than T1+30° C. nor higher than T1+200° C., a temperature (° C.) after the reduction in the final pass in the temperature region of not lower than T1+30° C. nor higher than T1+200° C., and a maximum working heat generation amount (° C.) at the time of the reduction in the temperature region of not lower than T1+30° C. nor higher than T1+200° C.

After the final reduction in the temperature region of not lower than T1+30° C. nor higher than T1+200° C. was performed in the finish rolling, pre-cold rolling primary cooling was started before a waiting time t second exceeding 2.5×t1. In the pre-cold rolling primary cooling, an average cooling rate was set to 50° C./second or more. Further, a temperature change (a cooled temperature amount) in the pre-cold rolling primary cooling was set to fall within a range of not less than 40° C. nor more than 140° C.

However, with respect to Steel type J2, the pre-cold rolling primary cooling was started after the waiting time t second exceeded 2.5×t1 since the final reduction in the temperature region of not lower than T1+30° C. nor higher than T1+200° C. in the finish rolling. With regard to Steel type T2, the temperature change (cooled temperature amount) in the pre-cold rolling primary cooling was less than 40° C., and with regard to Steel type J3, the temperature change (cooled temperature amount) in the pre-cold rolling primary cooling was greater than 140° C. With regard to Steel type T3, the average cooling rate in the pre-cold rolling primary cooling was less than 50° C./second.

Table 2 shows t1 (second) of the respective steel types, the waiting time t (second) from the final reduction in the temperature region of not lower than T1+30° C. nor higher than T1+200° C. to the start of the pre-cold rolling primary cooling in the finish rolling, t/t1, the temperature change (cooled amount) (° C.) in the pre-cold rolling primary cooling, and the average cooling rate (° C./second) in the pre-cold rolling primary cooling.

After the pre-cold rolling primary cooling, pre-cold rolling secondary cooling was performed. After the pre-cold rolling primary cooling, the pre-cold rolling secondary cooling was started within three seconds. Further, in the pre-cold rolling secondary cooling, the cooling was performed down to a cooling stop temperature of 600° C. or lower at an average cooling rate of 10 to 300° C./second, coiling was performed at 600° C. or lower, and hot-rolled original sheets each having a thickness of 2 to 5 mm were obtained.

However, with regard to Steel type D3, three seconds passed until the pre-cold rolling secondary cooling was started after the pre-cold rolling primary cooling. Further, with regard to Steel type D3, the average cooling rate of the pre-cold rolling secondary cooling was greater than 300° C./second. Further, with regard to Steel type E3, the cooling stop temperature of the pre-cold rolling secondary cooling (coiling temperature) was higher than 600° C. Table 2 shows, of the respective steel types, the time (second) to the start of the pre-cold rolling secondary cooling after the pre-cold rolling primary cooling, the average cooling rate (° C./second) of the pre-cold rolling secondary cooling, and the cooling stop temperature (° C.) of the pre-cold rolling secondary cooling (coiling temperature).

Next, the hot-rolled original sheets were each pickled to then be subjected to cold rolling at a reduction ratio of not less than 30% nor more than 70%. However, with regard to Steel type T4, the reduction ratio of the cold rolling was less than 30%. Further, with regard to Steel type T5, the reduction ratio of the cold rolling was greater than 70%. Table 3 shows the reduction ratio (%) of the cold rolling of the respective steel types.

After the cold rolling, heating was performed up to a temperature region of 700 to 900° C. and holding was performed for not shorter than 1 second nor longer than 1000 seconds. Further, when the heating was performed up to the temperature region of 700 to 900° C., an average heating rate HR1(° C./second) of not lower than room temperature nor higher than 650° C. was set to 0.3 or more (HR1≥0.3), and an average heating rate HR2(° C./second) of higher than 650° C. to 700 to 900° C. was set to 0.5×HR1 or less (HR2≤0.5×HR1).

However, with regard to Steel type A1, a heating temperature was higher than 900° C. With regard to Steel type Q2, the heating temperature was lower than 700° C. With regard to Steel type Q3, a heating and holding time was shorter than one second. With regard to Steel type Q4, the heating and holding time was longer than 1000 seconds. Further, with regard to Steel type T6, the average heating rate HR1 was less than 0.3 (° C./second). With regard to Steel type T7, the average heating rate HR2 (° C./second) was greater than 0.5×HR1. Table 3 shows the heating temperature (° C.) and the average heating rates HR1 and HR2 (° C./second) of the respective steel types.

After the heating and holding, post-cold rolling primary cooling was performed down to a temperature region of 580 to 750° C. at an average cooling rate of 12° C./second or less. However, with regard to Steel type A2, the average cooling rate in the post-cold rolling primary cooling was greater than 12° C./second. Further, with regard to Steel type A2, a stop temperature of the post-cold rolling primary cooling was lower than 580° C., and with regard to Steel type K1, the stop temperature of the post-cold rolling primary cooling was higher than 740° C. Table 3 shows, of the respective steel types, the average cooling rate (° C./second) and the cooling stop temperature (° C.) in the post-cold rolling primary cooling.

Subsequently to the post-cold rolling primary cooling, post-cold rolling secondary cooling was performed down to a temperature region of 350 to 500° C. at an average cooling rate of 4 to 300° C./second. However, with regard to Steel type A5, the average cooling rate of the post-cold rolling secondary cooling was less than 4° C./second. With regard to Steel type P4, the average cooling rate of the post-cold rolling secondary cooling was greater than 300° C./second. Further, with regard to Steel type A2, a stop temperature of the post-cold rolling secondary cooling was higher than 500° C., and with regard to Steel type G1, the stop temperature of the post-cold rolling secondary cooling was lower than 350° C. Table 3 shows the average cooling rate (° C./second) in the post-cold rolling secondary cooling of the respective steel types.

Subsequently to the post-cold rolling secondary cooling, an overaging heat treatment (OA) was performed at the stop temperature of the post-cold rolling secondary cooling. The range of the temperature of this overaging heat treatment (OA) (stop temperature of the post-cold rolling secondary cooling) was set to not lower than 350° C. nor higher than 500° C. Further, the time of the overaging heat treatment (OA) was set to not shorter than t2 seconds nor longer than 400 seconds. However, with regard to Steel type A2, a heat treatment temperature of the overaging was higher than 500° C., and with regard to Steel type G1, the heat treatment temperature of the overaging was lower than 350° C. Further, with regard to Steel type D1, a treatment time of the overaging was shorter than t2 seconds, and with regard to Steel types C2 and G1, the treatment time of the overaging was longer than 400 seconds. Table 3 shows the heat treatment temperature of the overaging (° C.), t2 (second), and the treatment time (second) of the respective steel types.

After the overaging heat treatment, skin pass rolling at 0.5% was performed and material evaluation was performed. Incidentally, on Steel type S1, a hot-dip galvanizing treatment was performed. On Steel type T1, an alloying treatment was performed in a temperature region of 450 to 600° C. after galvanizing.

Table 4 shows area ratios (structural fractions) (%) of ferrite, bainite, pearlite, martensite, and retained austenite in a metal structure of the respective steel types, and, of the respective steel types, a mean volume diameter dia (average value) of crystal grains (μm), and a ratio of, of the crystal grains, a length dL in the rolling direction to a length dt in the sheet thickness direction: dL/dt. Table 5 shows, of the respective steel types, an average value of pole densities of the {100}<011> to {223}<110> orientation group and a pole density of the {332}<113> crystal orientation at a sheet thickness center portion being a range of ⅝ to ⅜ in sheet thickness from the surface of the steel sheet. Incidentally, the structural fraction was evaluated by the structural fraction before the skin pass rolling. Further, Table 5 shows, as mechanical properties of the respective steel types, tensile strength TS (MPa), uniform elongation u-El (%), an elongation percentage El (%), and a hole expansion ratio λ (%) as an index of the local deformability. Table 5 shows rC, rL, r30, and r60 each being the r value.

Incidentally, a tensile test was based on JIS Z 2241. A hole expansion test was based on the Japan Iron and Steel Federation standard JFS T1001. The pole density of each of the crystal orientations was measured using the previously described EBSP at a 0.5 μm pitch on a ⅜ to ⅝ region at sheet thickness of a cross section parallel to the rolling direction. Further, as indexes of the uniform elongation and the hole expandability, TS×EL was set to 8000 (MPa·%) or more, and desirably set to 9000 (MPa·%) or more, and TS×λ was set to 30000 (MPa·%) or more, preferably set to 40000 (MPa·%) or more, and still more preferably set to 50000 (MPa·%) or more.

TABLE 1

| | T1/° C. | C | Si | Mn | P | S | Al | N | O | Si + Al | Ti | Nb | B | Mg | Rem | Ca |
|---|---|---|---|---|---|---|---|---|---|---|---|---|---|---|---|---|
| A | 851 | 0.070 | 0.08 | 1.30 | 0.015 | 0.004 | 0.040 | 0.0026 | 0.0032 | 0.12 | — | 0.00 | — | — | — | — |
| B | 851 | 0.070 | 0.08 | 1.30 | 0.015 | 0.004 | 0.040 | 0.0026 | 0.0032 | 0.12 | — | 0.00 | 0.005 | — | — | — |
| C | 865 | 0.080 | 0.31 | 1.35 | 0.012 | 0.005 | 0.016 | 0.0032 | 0.0023 | 0.33 | — | 0.04 | — | — | — | — |
| D | 865 | 0.080 | 0.31 | 1.35 | 0.012 | 0.005 | 0.016 | 0.0032 | 0.0023 | 0.33 | — | 0.04 | — | — | — | 0.002 |
| E | 858 | 0.060 | 0.87 | 1.20 | 0.009 | 0.004 | 0.038 | 0.0033 | 0.0026 | 0.91 | — | 0.02 | — | — | 0.002 | — |
| F | 858 | 0.060 | 0.30 | 1.20 | 0.009 | 0.004 | 0.500 | 0.0033 | 0.0026 | 0.80 | — | 0.02 | — | — | 0.002 | — |
| G | 865 | 0.210 | 0.15 | 1.62 | 0.012 | 0.003 | 0.026 | 0.0033 | 0.0021 | 0.18 | 0.021 | 0.00 | 0.002 | — | — | — |
| H | 865 | 0.210 | 0.90 | 1.62 | 0.012 | 0.003 | 0.026 | 0.0033 | 0.0021 | 0.93 | 0.021 | 0.00 | 0.002 | — | — | — |
| I | 861 | 0.035 | 0.67 | 1.88 | 0.015 | 0.003 | 0.045 | 0.0028 | 0.0029 | 0.72 | — | 0.02 | — | 0 | — | 0.0015 |
| J | 886 | 0.035 | 0.67 | 1.88 | 0.015 | 0.003 | 0.045 | 0.0028 | 0.0029 | 0.72 | 0.1 | 0.02 | — | 0 | — | 0.0015 |
| K | 875 | 0.180 | 0.48 | 2.72 | 0.009 | 0.003 | 0.050 | 0.0036 | 0.0022 | 0.53 | — | — | — | 0 | — | — |
| L | 892 | 0.180 | 0.48 | 2.72 | 0.009 | 0.003 | 0.050 | 0.0036 | 0.0022 | 0.53 | — | 0.05 | — | 0 | — | 0.002 |
| M | 892 | 0.060 | 0.11 | 2.12 | 0.01 | 0.005 | 0.033 | 0.0028 | 0.0035 | 0.14 | 0.036 | 0.089 | 0.001 | — | — | — |
| N | 886 | 0.060 | 0.11 | 2.12 | 0.01 | 0.005 | 0.033 | 0.0028 | 0.0035 | 0.14 | 0.089 | 0.036 | 0.001 | — | — | — |
| O | 903 | 0.040 | 0.13 | 1.33 | 0.01 | 0.005 | 0.038 | 0.0032 | 0.0026 | 0.17 | 0.042 | 0.121 | 9E−04 | — | — | — |
| P | 903 | 0.040 | 0.13 | 1.33 | 0.01 | 0.005 | 0.038 | 0.0036 | 0.0029 | 0.17 | 0.042 | 0.121 | 9E−04 | — | 0.004 | — |
| Q | 852 | 0.180 | 0.50 | 0.90 | 0.008 | 0.003 | 0.045 | 0.0028 | 0.0029 | 0.55 | — | — | — | — | — | — |
| R | 852 | 0.180 | 0.30 | 1.30 | 0.08 | 0.002 | 0.030 | 0.0032 | 0.0022 | 0.33 | — | — | — | — | — | — |
| S | 852 | 0.180 | 0.21 | 1.30 | 0.01 | 0.002 | 0.650 | 0.0032 | 0.0035 | 0.86 | — | — | — | — | — | — |
| T | 880 | 0.035 | 0.02 | 1.30 | 0.01 | 0.002 | 0.035 | 0.0023 | 0.0033 | 0.06 | 0.12 | — | — | — | — | — |
| a | 856 | 0.450 | 0.52 | 1.33 | 0.26 | 0.003 | 0.045 | 0.0026 | 0.0019 | 0.57 | — | — | — | — | — | — |
| b | 1376 | 0.072 | 0.15 | 1.42 | 0.014 | 0.004 | 0.036 | 0.0022 | 0.0025 | 0.19 | — | 1.5 | — | — | — | — |
| c | 851 | 0.110 | 0.23 | 1.12 | 0.021 | 0.003 | 0.026 | 0.0025 | 0.0023 | 0.26 | — | — | — | 0.15 | — | — |
| d | 1154 | 0.250 | 0.23 | 1.56 | 0.024 | 0.12 | 0.034 | 0.0022 | 0.0023 | 0.26 | — | — | — | — | — | — |
| e | 854 | 0.250 | 0.23 | 1.54 | 0.02 | 0.002 | 0.038 | 0.0026 | 0.0032 | 0.27 | — | — | — | — | — | — |
| f | 854 | 0.250 | 0.21 | 1.54 | 0.02 | 0.002 | 0.034 | 0.0026 | 0.0023 | 0.24 | — | — | — | — | — | — |
| g | 853 | 0.220 | 0.2 | 1.53 | 0.015 | 0.004 | 0.031 | 0.0028 | 0.0026 | 0.23 | — | — | — | — | — | — |
| h | 852 | 0.180 | 2.30 | 0.90 | 0.008 | 0.003 | 0.045 | 0.0028 | 0.0022 | 2.35 | — | — | — | — | — | — |

| | Mo | Cr | Ni | W | Zr | As | V | Cu | Co | Sn | Pb | Y | Hf | NOTE |
|---|---|---|---|---|---|---|---|---|---|---|---|---|---|---|
| A | — | — | — | — | — | — | — | — | — | — | — | — | — | INVENTION STEEL |
| B | — | — | — | — | — | — | — | — | — | — | — | — | — | INVENTION STEEL |
| C | — | — | — | — | — | — | — | — | — | — | — | — | — | INVENTION STEEL |
| D | — | — | — | — | — | — | — | — | — | — | — | — | — | INVENTION STEEL |
| E | — | — | — | — | — | — | — | — | — | — | — | — | — | INVENTION STEEL |
| F | — | — | — | — | — | — | — | — | — | — | — | — | — | INVENTION STEEL |
| G | 0.03 | 0.35 | — | — | — | — | — | — | — | — | — | — | — | INVENTION STEEL |
| H | 0.03 | 0.35 | — | — | — | — | — | — | — | — | — | — | — | INVENTION STEEL |
| I | — | — | — | — | — | — | 0.03 | — | — | — | — | — | — | INVENTION STEEL |
| J | — | — | — | — | — | — | 0.03 | — | — | — | — | — | — | INVENTION STEEL |
| K | 0.1 | — | — | — | — | — | 0.1 | — | — | — | — | — | — | INVENTION STEEL |
| L | 0.1 | — | — | — | — | — | 0.1 | — | — | — | — | — | — | INVENTION STEEL |
| M | — | — | — | — | — | — | — | — | — | — | — | 0 | — | INVENTION STEEL |
| N | — | — | — | — | — | — | — | — | — | — | — | — | 0 | INVENTION STEEL |
| O | — | — | — | — | 0 | — | — | — | — | 0 | — | — | — | INVENTION STEEL |
| P | — | — | — | — | — | — | — | — | 0 | — | — | — | — | INVENTION STEEL |
| Q | — | — | — | 0.1 | — | — | — | — | — | — | — | — | — | INVENTION STEEL |
| R | — | — | 0.1 | — | — | — | — | — | — | — | — | — | — | INVENTION STEEL |
| S | — | — | — | — | — | — | — | — | — | — | 0 | — | — | INVENTION STEEL |
| T | — | — | — | — | — | 0..002 | — | 0.2 | — | — | — | — | — | INVENTION STEEL |
| a | — | — | — | — | — | — | — | — | — | — | — | — | — | COMPARATIVE STEEL |
| b | — | — | — | — | — | — | — | — | — | — | — | — | — | COMPARATIVE STEEL |
| c | — | — | — | — | — | — | — | — | — | — | — | — | — | COMPARATIVE STEEL |
| d | — | 5.0 | — | — | — | — | 2.5 | — | — | — | — | — | — | COMPARATIVE STEEL |
| e | — | — | — | — | — | — | — | — | 1.2 | — | — | — | — | COMPARATIVE STEEL |
| f | — | — | — | — | — | — | — | — | — | — | 0.3 | — | — | COMPARATIVE STEEL |
| g | — | — | — | — | — | — | — | — | — | — | — | 0.3 | — | COMPARATIVE STEEL |
| h | — | — | — | — | — | — | — | — | — | — | — | — | — | COMPARATIVE STEEL |

TABLE 2

| STEEL TYPE | $Ac_1$/ ° C. | T1/ ° C. | NUMBER OF TIMES OF REDUCTION AT 40% OR MORE AT NOT LOWER THAN 1000° C. NOR HIGHER THAN 1200° C. | REDUCTION RATIO AT 40% OR MORE AT NOT LOWER THAN 1000° C. NOR HIGHER THAN 1200° C. | AUSTENITE GRAIN DIAMETER/ μm | REDUCTION RATIO AT T1 + 30 TO T1 + 200° C./ % | MAXIMUM WORKING HEAT GENERATION AT REDUCTION AT T1 + 30 TO T1 + 200° C./ % | Tf : TEMPERATURE AFTER FINAL REDUCTION AT 30% OR MORE/ ° C. | REDUCTION RATIO OF PASS BEFORE FINAL AT T1 + 30 TO T1 + 200° C./ % | REDUCTION RATIO OF FINAL PASS AT T1 + 30 TO T1 + 200° C./ % | REDUCTION RATIO AT REDUCTION IN TEMPERATURE REGION OF LOWER THAN T1 + 30° C./ % | t1 | t: WAITING TIME TO START OF PRE-COLD ROLLING PRIMARY COOLING AFTER COMPLETION OF FINAL ROLLING AT 30% OR MORE/s | t/t1 | PRE-COLD ROLLING PRIMARY COOLING AMOUNT/ ° C. | PRE-COLD ROLLING PRIMARY COOLING RATE/ ° C./s | TIME TO START OF PRE-COLD ROLLING SECONDARY COOLING/ s | PRE-COLD ROLLING SECONDARY COOLING RATE/ ° C./s | COILING TEMPERATURE/ ° C. |
|---|---|---|---|---|---|---|---|---|---|---|---|---|---|---|---|---|---|---|---|
| A1 | 711 | 851 | 1 | 50 | 140 | 85 | 15 | 935 | 40 | 40 | 0 | 0.57 | 0.68 | 1.20 | 85 | 71 | 3.0 | 185.0 | 426 |
| A2 | 711 | 851 | 2 | 45/40 | 85 | 80 | 5 | 891 | 40 | 35 | 0 | 1.77 | 2.12 | 1.20 | 95 | 60 | 3.0 | 190.0 | 427 |
| A3 | 711 | 851 | 0 | — | 290 | 65 | 18 | 930 | 30 | 30 | 0 | 1.08 | 1.29 | 1.20 | 100 | 60 | 4.0 | 140.0 | 413 |
| A4 | 711 | 851 | 2 | 45/45 | 90 | 45 | 18 | 925 | 20 | 20 | 10 | 1.70 | 2.05 | 1.20 | 125 | 60 | 3.0 | 220.0 | 377 |
| A5 | 711 | 851 | 2 | 45/40 | 85 | 45 | 18 | 930 | 20 | 20 | 10 | 1.63 | 1.95 | 1.20 | 130 | 60 | 3.0 | 10.0 | 328 |
| A6 | 711 | 851 | 2 | 45/40 | 90 | 43 | 18 | 935 | 20 | 20 | 10 | 1.55 | 1.86 | 1.20 | 115 | 58 | 3.0 | 83.0 | 596 |
| B1 | 711 | 851 | 1 | 50 | 145 | 85 | 15 | 935 | 40 | 40 | 0 | 0.57 | 0.68 | 1.20 | 110 | 60 | 3.0 | 225.0 | 312 |
| B2 | 711 | 851 | 2 | 45/40 | 85 | 75 | 5 | 892 | 35 | 35 | 0 | 1.75 | 2.09 | 1.20 | 90 | 69 | 3.0 | 189.0 | 434 |
| B3 | 711 | 851 | 2 | 45/40 | 85 | 44 | 18 | 930 | 20 | 20 | 10 | 1.63 | 1.96 | 1.20 | 130 | 60 | 3.0 | 75.0 | 335 |
| C1 | 718 | 865 | 2 | 45/40 | 80 | 79 | 15 | 945 | 37 | 37 | 0 | 0.76 | 0.91 | 1.20 | 90 | 60 | 2.0 | 130.0 | 423 |
| C2 | 718 | 865 | 2 | 45/45 | 80 | 76 | 18 | 920 | 40 | 31 | 0 | 1.54 | 1.85 | 1.20 | 100 | 60 | 3.0 | 200.0 | 426 |
| C3 | 718 | 865 | 2 | 45/45 | 80 | 44 | 15 | 1080 | 10 | 30 | 0 | 0.23 | 0.27 | 1.20 | 110 | 55 | 2.0 | 210.0 | 329 |
| D1 | 718 | 865 | 2 | 45/45 | 80 | 82 | 15 | 950 | 40 | 37 | 0 | 0.67 | 0.80 | 1.20 | 110 | 60 | 3.0 | 200.0 | 496 |
| D2 | 718 | 865 | 2 | 45/45 | 80 | 67 | 18 | 922 | 31 | 31 | 0 | 1.50 | 1.80 | 1.20 | 90 | 75 | 3.0 | 110.0 | 452 |
| D3 | 718 | 865 | 3 | 40/40/40 | 60 | 76 | 18 | 922 | 40 | 31 | 0 | 1.50 | 1.80 | 1.20 | 95 | 70 | 38.0 | 320.0 | 514 |
| E1 | 735 | 858 | 2 | 45/45 | 90 | 67 | 13 | 955 | 31 | 31 | 0 | 0.73 | 0.87 | 1.20 | 80 | 73 | 3.0 | 215.0 | 477 |
| E2 | 735 | 858 | 2 | 45/45 | 90 | 85 | 14 | 933 | 40 | 40 | 0 | 0.73 | 0.88 | 1.20 | 75 | 70 | 3.0 | 205.0 | 518 |
| E3 | 735 | 858 | 0 | — | 320 | 65 | 13 | 930 | 30 | 30 | 0 | 1.21 | 2.31 | 1.90 | 100 | 71 | 3.0 | 135.0 | 660 |
| F1 | 719 | 858 | 2 | 45/40 | 90 | 67 | 13 | 955 | 31 | 31 | 0 | 0.73 | 1.38 | 1.90 | 80 | 70 | 3.0 | 210.0 | 477 |
| F2 | 719 | 858 | 2 | 45/40 | 90 | 85 | 14 | 933 | 40 | 40 | 0 | 0.73 | 1.39 | 1.90 | 110 | 70 | 3.0 | 200.0 | 518 |
| F3 | 719 | 858 | 2 | 45/40 | 95 | 67 | 13 | 955 | 31 | 31 | 0 | 0.73 | 1.38 | 1.90 | 100 | 100 | 3.0 | 158.0 | 484 |
| G1 | 716 | 865 | 2 | 45/45 | 95 | 85 | 14 | 935 | 40 | 40 | 0 | 0.84 | 1.59 | 1.90 | 90 | 70 | 3.0 | 165.0 | 448 |
| G2 | 716 | 865 | 2 | 40/45 | 95 | 65 | 12 | 875 | 30 | 30 | 10 | 2.79 | 5.30 | 1.90 | 125 | 70 | 3.0 | 160.0 | 494 |
| H1 | 738 | 865 | 3 | 40/40/40 | 55 | 65 | 16 | 970 | 30 | 30 | 0 | 0.66 | 1.26 | 1.90 | 110 | 70 | 3.0 | 77.0 | 416 |
| I1 | 722 | 861 | 2 | 45/40 | 95 | 75 | 17 | 961 | 40 | 30 | 0 | 0.73 | 1.39 | 1.90 | 110 | 79 | 3.0 | 188.0 | 546 |
| I2 | 722 | 861 | 1 | 50 | 130 | 65 | 18 | 922 | 30 | 30 | 0 | 1.44 | 2.73 | 1.90 | 110 | 70 | 3.0 | 75.0 | 443 |
| I3 | 722 | 861 | 1 | 70 | 140 | 85 | 40 | 860 | 40 | 40 | 20 | 3.14 | 6.91 | 2.20 | 90 | 70 | 3.0 | 175.0 | 521 |
| J1 | 722 | 886 | 2 | 45/40 | 85 | 65 | 17 | 960 | 30 | 30 | 0 | 1.17 | 2.58 | 2.20 | 95 | 70 | 2.0 | 160.0 | 465 |
| J2 | 722 | 886 | 1 | 50 | 125 | 65 | 18 | 920 | 30 | 30 | 0 | 2.09 | 10.30 | 4.93 | 100 | 63 | 3.0 | 70.0 | 532 |
| J3 | 722 | 886 | 1 | 50 | 125 | 65 | 18 | 920 | 30 | 30 | 0 | 2.09 | 4.60 | 2.20 | 235 | 70 | 3.0 | 78.0 | 380 |
| K1 | 708 | 875 | 3 | 40/40/40 | 65 | 75 | 18 | 990 | 40 | 30 | 0 | 0.53 | 1.17 | 2.20 | 90 | 70 | 3.0 | 165.0 | 437 |
| L1 | 708 | 892 | 3 | 40/40/40 | 70 | 65 | 18 | 990 | 30 | 30 | 0 | 0.77 | 1.69 | 2.20 | 90 | 70 | 3.0 | 75.0 | 375 |
| M1 | 704 | 892 | 3 | 40/40/40 | 65 | 75 | 10 | 943 | 35 | 35 | 0 | 1.46 | 3.21 | 2.20 | 125 | 74 | 3.0 | 145.0 | 378 |
| M2 | 704 | 892 | 0 | — | 390 | 65 | 30 | 942 | 20 | 40 | 0 | 1.32 | 2.90 | 2.20 | 80 | 70 | 3.0 | 166.0 | 394 |
| N1 | 704 | 886 | 3 | 40/40/40 | 65 | 75 | 10 | 940 | 35 | 35 | 0 | 1.40 | 3.09 | 2.20 | 100 | 65 | 3.0 | 186.0 | 431 |

TABLE 2-continued

| STEEL TYPE | $Ac_1$/ ° C. | T1/ ° C. | NUMBER OF TIMES OF REDUCTION AT 40% OR MORE AT NOT LOWER THAN 1000° C. NOR HIGHER THAN 1200° C. | REDUCTION RATIO AT 40% OR MORE AT NOT LOWER THAN 1000° C. NOR HIGHER THAN 1200° C. | AUSTENITE GRAIN DIAMETER/ μm | REDUCTION RATIO AT T1 + 30 TO T1 + 200° C./ % | MAXIMUM WORKING HEAT GENERATION AT REDUCTION AT T1 + 30 TO T1 + 200° C./ % | Tf : TEMPERATURE AFTER FINAL REDUCTION AT 30% OR MORE/ ° C. | REDUCTION RATIO OF PASS BEFORE FINAL AT T1 + 30 TO T1 + 200° C./ % | REDUCTION RATIO OF FINAL PASS AT T1 + 30 TO T1 + 200° C./ % | REDUCTION RATIO AT REDUCTION IN TEMPERATURE REGION OF LOWER THAN T1 + 30° C./ % | t1 | t: WAITING TIME TO START OF PRE-COLD ROLLING PRIMARY COOLING AFTER COMPLETION OF FINAL ROLLING AT 30% OR MORE/s | t/t1 | PRE-COLD ROLLING PRIMARY COOLING AMOUNT/ ° C. | PRE-COLD ROLLING PRIMARY COOLING RATE/ ° C./s | TIME TO START OF PRE-COLD ROLLING SECONDARY COOLING/ s | PRE-COLD ROLLING SECONDARY COOLING RATE/ ° C./s | COILING TEMPERATURE/ ° C. |
|---|---|---|---|---|---|---|---|---|---|---|---|---|---|---|---|---|---|---|---|
| O1 | 713 | 903 | 2 | 45/45 | 75 | 85 | 15 | 985 | 40 | 40 | 0 | 0.61 | 1.34 | 2.20 | 110 | 65 | 2.0 | 100.0 | 335 |
| O2 | 713 | 903 | 2 | 45/45 | 120 | 65 | 12 | 880 | 30 | 30 | 20 | 3.92 | 8.62 | 2.20 | 90 | 50 | 3.0 | 95.0 | 384 |
| P1 | 713 | 903 | 2 | 45/45 | 70 | 85 | 13 | 1012 | 40 | 40 | 0 | 0.25 | 0.56 | 2.20 | 95 | 65 | 3.0 | 104.0 | 435 |
| P2 | 713 | 903 | 2 | 45/40 | 80 | 78 | 14 | 944 | 38 | 38 | 40 | 0.76 | 0.93 | 1.23 | 95 | 55 | 2.0 | 135.0 | 425 |
| P3 | 713 | 903 | 2 | 45/45 | 80 | 68 | 18 | 924 | 30 | 30 | 35 | 1.50 | 1.82 | 1.22 | 95 | 75 | 3.0 | 105.0 | 455 |
| P4 | 713 | 903 | 2 | 45/45 | 90 | 84 | 15 | 930 | 40 | 40 | 0 | 0.73 | 0.89 | 1.22 | 75 | 77 | 3.0 | 210.0 | 510 |
| Q1 | 728 | 852 | 2 | 45/45 | 80 | 85 | 10 | 958 | 40 | 40 | 0 | 0.28 | 0.62 | 2.20 | 110 | 65 | 3.0 | 75.0 | 482 |
| Q2 | 728 | 852 | 2 | 45/40 | 95 | 76 | 18 | 962 | 40 | 30 | 0 | 0.73 | 1.40 | 1.92 | 115 | 80 | 3.0 | 192.0 | 549 |
| Q3 | 728 | 852 | 1 | 50 | 145 | 84 | 14 | 938 | 42 | 40 | 0 | 0.57 | 0.69 | 1.21 | 105 | 65 | 3.0 | 221.0 | 316 |
| Q4 | 728 | 852 | 1 | 50 | 130 | 66 | 17 | 925 | 31 | 32 | 0 | 1.44 | 2.75 | 1.91 | 105 | 75 | 3.0 | 78.0 | 448 |
| R1 | 733 | 852 | 2 | 45/45 | 80 | 85 | 12 | 996 | 40 | 40 | 0 | 0.14 | 0.31 | 2.20 | 90 | 65 | 3.0 | 180.0 | 410 |
| R2 | 733 | 852 | 2 | 45/45 | 75 | 85 | 12 | 990 | 40 | 40 | 0 | 0.13 | 0.10 | 0.80 | 90 | 75 | 3.0 | 180.0 | 410 |
| R3 | 733 | 852 | 2 | 45/45 | 80 | 65 | 13 | 996 | 35 | 35 | 0 | 0.15 | 0.10 | 0.70 | 90 | 65 | 2.5 | 145.0 | 420 |
| R4 | 733 | 852 | 2 | 45/45 | 70 | 85 | 12 | 999 | 40 | 40 | 0 | 0.15 | 0.11 | 0.75 | 90 | 65 | 3.0 | 180.0 | 425 |
| S1 | 715 | 852 | 2 | 45/45 | 80 | 75 | 12 | 958 | 30 | 40 | 0 | 0.28 | 0.62 | 2.20 | 90 | 53 | 3.0 | 140.0 | 401 |
| S2 | 715 | 852 | 2 | 45/45 | 65 | 75 | 12 | 958 | 30 | 40 | 0 | 0.28 | 0.18 | 0.65 | 90 | 65 | 3.0 | 140.0 | 401 |
| S3 | 715 | 852 | 2 | 45/45 | 80 | 70 | 16 | 960 | 35 | 35 | 0 | 0.41 | 0.37 | 0.90 | 90 | 65 | 2.0 | 160.0 | 430 |
| S4 | 715 | 852 | 2 | 45/45 | 85 | 75 | 12 | 959 | 30 | 40 | 0 | 0.27 | 0.21 | 0.80 | 90 | 69 | 3.0 | 140.0 | 435 |
| T1 | 710 | 880 | 2 | 45/45 | 75 | 70 | 12 | 985 | 30 | 35 | 0 | 0.44 | 0.98 | 2.20 | 95 | 75 | 2.0 | 180.0 | 359 |
| T2 | 710 | 880 | 2 | 45/45 | 75 | 70 | 12 | 984 | 30 | 35 | 0 | 0.46 | 1.02 | 2.20 | 25 | 75 | 2.0 | 180.0 | 356 |
| T3 | 710 | 880 | 2 | 45/45 | 110 | 75 | 12 | 984 | 35 | 35 | 0 | 0.46 | 1.02 | 2.20 | 95 | 30 | 2.0 | 167.0 | 478 |
| T4 | 710 | 880 | 2 | 45/45 | 80 | 75 | 14 | 984 | 30 | 40 | 0 | 0.30 | 0.66 | 2.20 | 95 | 75 | 2.0 | 166.0 | 359 |
| T5 | 710 | 880 | 2 | 45/45 | 75 | 65 | 12 | 983 | 35 | 35 | 0 | 0.48 | 1.05 | 2.20 | 95 | 68 | 2.5 | 180.0 | 440 |
| T6 | 710 | 880 | 2 | 45/45 | 85 | 75 | 15 | 984 | 30 | 40 | 0 | 0.30 | 0.66 | 2.20 | 95 | 75 | 2.0 | 187.0 | 362 |
| T7 | 710 | 880 | 2 | 45/45 | 75 | 80 | 12 | 982 | 30 | 35 | 0 | 0.49 | 1.08 | 2.20 | 95 | 75 | 3.0 | 180.0 | 355 |
| a1 | 724 | 855 | CRACKING OCCURRED DURING HOT ROLLING | | | | | | | | | | | | | | | | |
| b1 | 712 | 1376 | | | | | | | | | | | | | | | | | |
| c1 | 718 | 851 | | | | | | | | | | | | | | | | | |
| d1 | 798 | 1154 | | | | | | | | | | | | | | | | | |
| e1 | 713 | 850 | | | | | | | | | | | | | | | | | |
| f1 | 713 | 850 | | | | | | | | | | | | | | | | | |
| g1 | 712 | 850 | | | | | | | | | | | | | | | | | |
| h1 | 780 | 852 | | | | | | | | | | | | | | | | | |

TABLE 3

| STEEL TYPE | COLD ROLLING RATIO/ % | HR1/ ° C./s | HR2/ ° C./s | HEATING TEMPERATURE/ ° C. | HOLDING TIME AT HEATING TEMPERATURE/ s | POST-COLD ROLLING PRIMARY COOLING RATE/ ° C./s | POST-COLD ROLLING PRIMARY COOLING STOP TEMPERATURE/ ° C. | POST-COLD ROLLING SECONDARY COOLING RATE/ ° C./s | TEMPERATURE AT OA/ ° C. | HOLDING TIME AT OA/ s | t2/ s | PRESENCE/ABSENCE OF GALVANIZING | ALLOYING TEMPERATURE/ ° C. |
|---|---|---|---|---|---|---|---|---|---|---|---|---|---|
| A1 | 34 | 7.0 | 2.5 | 956 | 168 | 11 | 650 | 50 | 480 | 226 | 61 | ABSENCE | — |
| A2 | 38 | 2.6 | 0.9 | 750 | 131 | 44 | 510 | 50 | 480 | 226 | 61 | ABSENCE | — |
| A3 | 42 | 0.9 | 0.3 | 800 | 142 | 10 | 740 | 50 | 370 | 226 | 61 | ABSENCE | — |
| A4 | 39 | 5.3 | 1.8 | 834 | 104 | 12 | 655 | 50 | 370 | 226 | 61 | ABSENCE | — |
| A5 | 41 | 7.9 | 2.8 | 778 | 121 | 11 | 639 | 3 | 570 | 230 | 400 | ABSENCE | — |
| A6 | 52 | 1.8 | 0.6 | 770 | 128 | 11 | 700 | 50 | 372 | 220 | 55 | ABSENCE | — |
| B1 | 60 | 8.8 | 3.1 | 776 | 149 | 11 | 689 | 50 | 450 | 185 | 20 | ABSENCE | — |
| B2 | 60 | 8.8 | 3.1 | 820 | 113 | 10 | 688 | 49 | 450 | 185 | 20 | ABSENCE | — |
| B3 | 41 | 8.8 | 3.1 | 792 | 91 | 12 | 632 | 50 | 440 | 182 | 17 | ABSENCE | — |
| C1 | 47 | 4.4 | 1.5 | 840 | 157 | 11 | 727 | 49 | 450 | 185 | 20 | ABSENCE | — |
| C2 | 32 | 8.8 | 3.1 | 830 | 146 | 11 | 682 | 48 | 317 | 550 | 400 | ABSENCE | — |
| C3 | 60 | 8.8 | 3.1 | 808 | 174 | 12 | 681 | 49 | 480 | 226 | 61 | ABSENCE | — |
| D1 | 32 | 7.0 | 2.5 | 780 | 46 | 10 | 673 | 49 | 480 | 36 | 61 | ABSENCE | — |
| D2 | 31 | 1.8 | 0.6 | 886 | 176 | 11 | 659 | 49 | 326 | 276 | 400 | ABSENCE | — |
| D3 | 38 | 3.5 | 1.2 | 843 | 145 | 9 | 588 | 50 | 405 | 183 | 18 | ABSENCE | — |
| E1 | 48 | 0.9 | 0.3 | 867 | 111 | 10 | 694 | 49 | 406 | 183 | 18 | ABSENCE | — |
| E2 | 50 | 7.0 | 1.7 | 774 | 114 | 9 | 737 | 49 | 380 | 203 | 38 | ABSENCE | — |
| E3 | 33 | 7.9 | 1.9 | 756 | 150 | 12 | 700 | 49 | 415 | 181 | 16 | ABSENCE | — |
| F1 | 48 | 1.8 | 0.4 | 867 | 163 | 10 | 694 | 48 | 406 | 183 | 18 | ABSENCE | — |
| F2 | 50 | 0.9 | 0.2 | 780 | 66 | 9 | 737 | 48 | 444 | 183 | 18 | ABSENCE | — |
| F3 | 53 | 8.8 | 2.1 | 760 | 118 | 10 | 666 | 48 | 410 | 182 | 17 | ABSENCE | — |
| G1 | 43 | 8.8 | 2.1 | 808 | 123 | 12 | 598 | 49 | 265 | 575 | 400 | ABSENCE | — |
| G2 | 60 | 6.2 | 1.5 | 768 | 99 | 11 | 679 | 50 | 458 | 190 | 25 | ABSENCE | — |
| H1 | 44 | 3.5 | 0.8 | 794 | 117 | 10 | 702 | 48 | 363 | 254 | 89 | ABSENCE | — |
| I1 | 34 | 7.0 | 1.7 | 895 | 158 | 10 | 636 | 50 | 456 | 189 | 24 | ABSENCE | — |
| I2 | 40 | 4.4 | 1.1 | 856 | 68 | 12 | 707 | 48 | 356 | 301 | 136 | ABSENCE | — |
| I3 | 38 | 1.8 | 0.4 | 880 | 168 | 12 | 591 | 49 | 365 | 244 | 79 | ABSENCE | — |
| J1 | 35 | 5.3 | 1.3 | 775 | 127 | 9 | 733 | 48 | 373 | 218 | 53 | ABSENCE | — |
| J2 | 57 | 6.2 | 1.5 | 783 | 111 | 10 | 725 | 50 | 459 | 191 | 26 | ABSENCE | — |
| J3 | 66 | 6.2 | 1.5 | 846 | 180 | 9 | 737 | 49 | 370 | 226 | 61 | ABSENCE | — |
| K1 | 44 | 6.2 | 1.5 | 770 | 103 | 9 | 760 | 49 | 434 | 181 | 16 | ABSENCE | — |
| L1 | 52 | 8.8 | 2.1 | 775 | 136 | 9 | 657 | 50 | 416 | 181 | 16 | ABSENCE | — |
| M1 | 40 | 7.0 | 2.5 | 780 | 152 | 11 | 730 | 48 | 441 | 182 | 17 | ABSENCE | — |
| M2 | 35 | 0.9 | 0.3 | 870 | 110 | 11 | 612 | 49 | 385 | 197 | 32 | ABSENCE | — |
| N1 | 31 | 7.9 | 2.9 | 850 | 142 | 12 | 588 | 49 | 476 | 215 | 50 | ABSENCE | — |
| O1 | 54 | 1.8 | 0.6 | 756 | 131 | 11 | 660 | 50 | 477 | 218 | 53 | ABSENCE | — |
| O2 | 47 | 7.9 | 2.9 | 790 | 166 | 12 | 647 | 49 | 406 | 183 | 18 | ABSENCE | — |
| P1 | 33 | 8.8 | 3.2 | 850 | 124 | 12 | 593 | 49 | 459 | 191 | 26 | ABSENCE | — |
| P2 | 46 | 4.3 | 1.5 | 842 | 158 | 11 | 726 | 49 | 452 | 185 | 20 | ABSENCE | — |
| P3 | 30 | 1.7 | 0.6 | 888 | 175 | 11 | 660 | 49 | 325 | 276 | 400 | ABSENCE | — |

TABLE 3-continued

| STEEL TYPE | COLD ROLLING RATIO/ % | HR1/ ° C./s | HR2/ ° C./s | HEATING TEMPERATURE/ ° C. | HOLDING TIME AT HEATING TEMPERATURE/ s | POST-COLD ROLLING PRIMARY COOLING RATE/ ° C./s | POST-COLD ROLLING PRIMARY COOLING STOP TEMPERATURE/ ° C. | POST-COLD ROLLING SECONDARY COOLING RATE/ ° C./s | TEMPERATURE AT OA/ ° C. | HOLDING TIME AT OA/ s | t2/ s | PRESENCE/ABSENCE OF GALVANIZING | ALLOYING TEMPERATURE/ ° C. |
|---|---|---|---|---|---|---|---|---|---|---|---|---|---|
| P4 | 51 | 7.1 | 1.7 | 775 | 113 | 9 | 740 | 358 | 379 | 203 | 38 | ABSENCE | — |
| Q1 | 55 | 7.0 | 2.7 | 899 | 157 | 10 | 746 | 49 | 450 | 185 | 20 | ABSENCE | — |
| Q2 | 35 | 7.0 | 1.7 | 588 | 159 | 10 | 635 | 50 | 455 | 189 | 24 | ABSENCE | — |
| Q3 | 62 | 8.9 | 3.1 | 778 | 0.4 | 11 | 690 | 50 | 449 | 185 | 20 | ABSENCE | — |
| Q4 | 41 | 4.4 | 1.1 | 857 | 1360 | 12 | 705 | 48 | 357 | 301 | 136 | ABSENCE | — |
| R1 | 37 | 5.3 | 2.0 | 883 | 158 | 11 | 719 | 50 | 466 | 198 | 33 | ABSENCE | — |
| R2 | 44 | 6.2 | 2.3 | 873 | 67 | 11 | 725 | 49 | 477 | 218 | 53 | ABSENCE | — |
| R3 | 37 | 0.9 | 0.3 | 870 | 99 | 10 | 718 | 50 | 476 | 215 | 50 | ABSENCE | — |
| R4 | 36 | 0.9 | 0.3 | 854 | 111 | 11 | 719 | 48 | 420 | 180 | 15 | ABSENCE | — |
| S1 | 50 | 1.8 | 0.7 | 766 | 101 | 11 | 652 | 50 | 450 | 185 | 20 | PRESENCE | NO ALLOYING |
| S2 | 48 | 8.8 | 3.3 | 770 | 119 | 12 | 662 | 47 | 449 | 185 | 20 | ABSENCE | — |
| S3 | 49 | 7.0 | 2.7 | 780 | 87 | 11 | 670 | 50 | 458 | 190 | 25 | ABSENCE | — |
| S4 | 50 | 0.9 | 0.3 | 765 | 95 | 9 | 668 | 48 | 452 | 186 | 21 | ABSENCE | — |
| T1 | 47 | 1.8 | 0.7 | 760 | 121 | 12 | 642 | 49 | 422 | 180 | 15 | PRESENCE | 585 |
| T2 | 47 | 6.2 | 2.3 | 880 | 54 | 12 | 670 | 49 | 378 | 207 | 42 | ABSENCE | — |
| T3 | 44 | 0.9 | 0.3 | 776 | 74 | 11 | 655 | 50 | 376 | 211 | 46 | ABSENCE | — |
| T4 | 14 | 1.8 | 0.7 | 890 | 91 | 12 | 657 | 50 | 446 | 184 | 19 | ABSENCE | — |
| T5 | 89 | 8.8 | 3.3 | 774 | 130 | 9 | 660 | 49 | 389 | 192 | 27 | ABSENCE | — |
| T6 | 47 | 0.2 | 0.1 | 768 | 138 | 10 | 735 | 48 | 467 | 199 | 34 | ABSENCE | — |
| T7 | 43 | 1.8 | 1.6 | 761 | 85 | 12 | 732 | 49 | 389 | 192 | 27 | ABSENCE | — |
| a1 | CRACKING OCCURRED DURING HOT ROLLING | | | | | | | | | | | | |
| b1 | | | | | | | | | | | | | |
| c1 | | | | | | | | | | | | | |
| d1 | | | | | | | | | | | | | |
| e1 | | | | | | | | | | | | | |
| f1 | | | | | | | | | | | | | |
| g1 | | | | | | | | | | | | | |
| h1 | | | | | | | | | | | | | |

TABLE 4

| STEEL TYPE | FERRITE FRAC-TION/ % | BAINITE FRAC-TION/ % | PEARLITE FRAC-TION/ % | MARTEN-SITE FRACTION fM/% | RETAINED γ FRAC-TION/ % | dia (μm) | dL(μm) | dT (μm) | EXPRES-SION 3 dL/dt | NOTE |
|---|---|---|---|---|---|---|---|---|---|---|
| A1 | 57.2 | 39.5 | 3.1 | 0.1 | 0.1 | 230.0 | 235.9 | 213.8 | 1.1 | COMPARATIVE STEEL |
| A2 | 2.0 | 97.4 | 0.2 | 0.3 | 0.1 | 5.8 | 5.4 | 3.2 | 1.7 | COMPARATIVE STEEL |
| A3 | 59.2 | 40.0 | 0.1 | 0.4 | 0.3 | 10.0 | 9.6 | 9.6 | 1.0 | COMPARATIVE STEEL |
| A4 | 62.9 | 36.0 | 0.2 | 0.6 | 0.3 | 8.0 | 7.6 | 2.3 | 3.3 | COMPARATIVE STEEL |
| A5 | 56.2 | 33.4 | 0.1 | 10.1 | 0.2 | 8.0 | 7.6 | 1.9 | 4.0 | COMPARATIVE STEEL |
| A6 | 61.6 | 38.0 | 0.1 | 0.1 | 0.2 | 7.9 | 7.5 | 0.8 | 9.0 | COMPARATIVE STEEL |
| B1 | 60.6 | 39.0 | 0.1 | 0.1 | 0.2 | 5.3 | 4.9 | 2.7 | 1.8 | PRESENT INVENTION STEEL |
| B2 | 55.0 | 44.0 | 0.1 | 0.7 | 0.2 | 5.8 | 5.4 | 2.5 | 2.1 | PRESENT INVENTION STEEL |
| B3 | 60.7 | 37.0 | 0.1 | 0.9 | 1.3 | 8.0 | 7.6 | 1.8 | 4.1 | COMPARATIVE STEEL |
| C1 | 64.0 | 35.0 | 0.1 | 0.6 | 0.3 | 5.5 | 5.1 | 2.6 | 1.9 | PRESENT INVENTION STEEL |
| C2 | 60.0 | 4.3 | 0.1 | 0.8 | 34.8 | 6.1 | 5.7 | 2.4 | 2.3 | COMPARATIVE STEEL |
| C3 | 65.4 | 33.0 | 0.4 | 0.9 | 0.3 | 5.7 | 5.3 | 2.5 | 2.1 | COMPARATIVE STEEL |
| D1 | 53.8 | 6.0 | 0.1 | 39.8 | 0.3 | 5.4 | 5.0 | 2.0 | 2.6 | COMPARATIVE STEEL |
| D2 | 58.0 | 38.0 | 3.1 | 0.8 | 0.1 | 6.1 | 6.9 | 4.6 | 1.5 | PRESENT INVENTION STEEL |
| D3 | 42.3 | 57.0 | 0.1 | 0.5 | 0.1 | 11.0 | 11.8 | 7.8 | 1.5 | COMPARATIVE STEEL |
| E1 | 55.5 | 41.9 | 2.1 | 0.4 | 0.1 | 6.0 | 6.8 | 3.3 | 2.1 | PRESENT INVENTION STEEL |
| E2 | 53.1 | 42.7 | 4.0 | 0.0 | 0.2 | 5.3 | 6.1 | 3.3 | 1.8 | PRESENT INVENTION STEEL |
| E3 | 67.2 | 28.0 | 3.7 | 0.9 | 0.2 | 10.9 | 11.7 | 7.8 | 1.5 | COMPARATIVE STEEL |
| F1 | 55.5 | 41.9 | 1.5 | 0.9 | 0.2 | 6.0 | 6.8 | 5.6 | 1.2 | PRESENT INVENTION STEEL |
| F2 | 53.1 | 43.0 | 3.1 | 0.5 | 0.3 | 5.3 | 6.1 | 3.2 | 1.9 | PRESENT INVENTION STEEL |
| F3 | 53.3 | 44.7 | 1.5 | 0.3 | 0.2 | 6.0 | 6.8 | 3.9 | 1.7 | PRESENT INVENTION STEEL |
| G1 | 57.4 | 2.0 | 0.2 | 40.2 | 0.2 | 5.3 | 6.1 | 3.2 | 1.9 | COMPARATIVE STEEL |
| G2 | 59.8 | 36.0 | 3.7 | 0.3 | 0.2 | 6.4 | 7.2 | 7.0 | 1.0 | COMPARATIVE STEEL |
| H1 | 56.2 | 40.0 | 3.2 | 0.5 | 0.1 | 6.0 | 6.8 | 3.0 | 2.2 | PRESENT INVENTION STEEL |
| I1 | 50.9 | 46.0 | 2.7 | 0.2 | 0.2 | 6.1 | 6.9 | 3.3 | 2.1 | PRESENT INVENTION STEEL |
| I2 | 67.9 | 30.0 | 1.3 | 0.5 | 0.3 | 6.2 | 7.0 | 2.5 | 2.8 | PRESENT INVENTION STEEL |
| I3 | 56.7 | 40.0 | 2.4 | 0.6 | 0.3 | 8.3 | 9.1 | 4.5 | 2.0 | COMPARATIVE STEEL |
| J1 | 52.8 | 45.0 | 1.5 | 0.5 | 0.2 | 6.1 | 6.0 | 2.7 | 2.2 | PRESENT INVENTION STEEL |
| J2 | 58.0 | 40.0 | 1.7 | 0.1 | 0.2 | 9.0 | 8.9 | 4.1 | 2.2 | COMPARATIVE STEEL |
| J3 | 53.1 | 43.0 | 3.5 | 0.2 | 0.2 | 6.2 | 6.1 | 5.0 | 1.2 | COMPARATIVE STEEL |
| K1 | 90.7 | 2.0 | 7.1 | 0.1 | 0.1 | 6.0 | 5.9 | 3.4 | 1.7 | COMPARATIVE STEEL |
| L1 | 47.3 | 52.1 | 0.2 | 0.3 | 0.1 | 6.0 | 6.3 | 3.6 | 1.7 | PRESENT INVENTION STEEL |
| M1 | 64.2 | 35.0 | 0.3 | 0.4 | 0.1 | 5.6 | 5.9 | 2.0 | 2.9 | PRESENT INVENTION STEEL |
| M2 | 53.9 | 43.0 | 2.8 | 0.2 | 0.2 | 8.3 | 8.6 | 5.7 | 1.5 | COMPARATIVE STEEL |
| N1 | 56.4 | 39.0 | 4.1 | 0.3 | 0.2 | 5.6 | 5.9 | 2.9 | 2.0 | PRESENT INVENTION STEEL |
| O1 | 58.1 | 38.0 | 3.3 | 0.4 | 0.2 | 5.1 | 5.4 | 3.2 | 1.7 | PRESENT INVENTION STEEL |
| O2 | 62.1 | 33.0 | 4.3 | 0.4 | 0.2 | 8.3 | 8.6 | 2.4 | 3.6 | COMPARATIVE STEEL |
| P1 | 56.9 | 40.0 | 2.7 | 0.3 | 0.1 | 5.1 | 5.4 | 2.1 | 2.5 | PRESENT INVENTION STEEL |
| P2 | 64.0 | 35.0 | 0.1 | 0.6 | 0.3 | 2.5 | 2.8 | 0.6 | 4.7 | COMPARATIVE STEEL |
| P3 | 58.0 | 38.0 | 3.1 | 0.8 | 0.1 | 2.8 | 2.9 | 0.7 | 4.1 | COMPARATIVE STEEL |
| P4 | 43.2 | 1.0 | 0.1 | 55.4 | 0.3 | 5.3 | 6.1 | 3.3 | 1.8 | COMPARATIVE STEEL |
| Q1 | 59.7 | 38.0 | 2.1 | 0.1 | 0.1 | 5.2 | 5.5 | 2.4 | 2.3 | PRESENT INVENTION STEEL |
| Q2 | 86.0 | 2.2 | 11.4 | 0.2 | 0.2 | 6.1 | 6.9 | 3.3 | 2.1 | COMPARATIVE STEEL |
| Q3 | 78.9 | 1.5 | 0.1 | 19.3 | 0.2 | 5.3 | 4.9 | 2.7 | 1.8 | COMPARATIVE STEEL |
| Q4 | 67.9 | 30.0 | 1.3 | 0.5 | 0.3 | 220.5 | 221.0 | 220.0 | 2.8 | COMPARATIVE STEEL |
| R1 | 63.3 | 34.5 | 2.0 | 0.1 | 0.1 | 5.1 | 5.4 | 2.1 | 2.6 | PRESENT INVENTION STEEL |
| R2 | 63.1 | 35.2 | 1.3 | 0.2 | 0.2 | 4.1 | 4.4 | 1.8 | 2.5 | PRESENT INVENTION STEEL |
| R3 | 61.8 | 35.7 | 2.1 | 0.2 | 0.2 | 4.2 | 4.5 | 1.9 | 2.4 | PRESENT INVENTION STEEL |
| R4 | 58.9 | 38.9 | 1.9 | 0.1 | 0.2 | 4.0 | 4.3 | 1.9 | 2.3 | PRESENT INVENTION STEEL |
| S1 | 57.4 | 40.0 | 2.4 | 0.1 | 0.1 | 5.2 | 5.5 | 3.3 | 1.7 | PRESENT INVENTION STEEL |

TABLE 4-continued

| STEEL TYPE | FERRITE FRAC-TION/ % | BAINITE FRAC-TION/ % | PEARLITE FRAC-TION/ % | MARTEN-SITE FRACTION fM/% | RETAINED γ FRAC-TION/ % | dia (μm) | dL(μm) | dT (μm) | EXPRES-SION 3 dL/dt | NOTE |
|---|---|---|---|---|---|---|---|---|---|---|
| S2 | 59.4 | 39.2 | 1.1 | 0.2 | 0.1 | 4.0 | 4.3 | 1.7 | 2.5 | PRESENT INVENTION STEEL |
| S3 | 58.8 | 39.0 | 1.9 | 0.1 | 0.2 | 4.0 | 4.3 | 2.0 | 2.2 | PRESENT INVENTION STEEL |
| S4 | 52.9 | 45.2 | 1.6 | 0.1 | 0.2 | 4.1 | 4.4 | 1.6 | 2.8 | PRESENT INVENTION STEEL |
| T1 | 61.6 | 36.0 | 2.2 | 0.1 | 0.1 | 5.5 | 5.8 | 3.5 | 1.7 | PRESENT INVENTION STEEL |
| T2 | 61.5 | 36.5 | 1.8 | 0.1 | 0.1 | 8.6 | 8.9 | 2.4 | 3.7 | COMPARATIVE STEEL |
| T3 | 61.0 | 38.0 | 0.8 | 0.1 | 0.1 | 8.5 | 8.8 | 2.5 | 3.5 | COMPARATIVE STEEL |
| T4 | 56.9 | 40.3 | 2.1 | 0.4 | 0.3 | 9.0 | 9.3 | 0.9 | 10.0 | COMPARATIVE STEEL |
| T5 | 61.4 | 37.9 | 0.4 | 0.2 | 0.1 | 4.0 | 4.3 | 1.9 | 2.3 | COMPARATIVE STEEL |
| T6 | 60.6 | 38.6 | 0.5 | 0.2 | 0.1 | 3.8 | 4.1 | 1.8 | 2.3 | COMPARATIVE STEEL |
| T7 | 59.0 | 39.8 | 0.5 | 0.4 | 0.3 | 4.4 | 4.7 | 2.8 | 1.7 | COMPARATIVE STEEL |
| a1 | CRACKING OCCURRED DURING HOT ROLLING | | | | | | | | | COMPARATIVE STEEL |
| b1 | | | | | | | | | | COMPARATIVE STEEL |
| c1 | | | | | | | | | | COMPARATIVE STEEL |
| d1 | | | | | | | | | | COMPARATIVE STEEL |
| e1 | | | | | | | | | | COMPARATIVE STEEL |
| f1 | | | | | | | | | | COMPARATIVE STEEL |
| g1 | | | | | | | | | | COMPARATIVE STEEL |
| h1 | | | | | | | | | | COMPARATIVE STEEL |

TABLE 5

| STEEL TYPE | TS (Mpa) | u-EL(%) | EL(%) | λ(%) | AVERAGE VALUE OF POLE DENSITIES OF {100}<011> TO {223}<110> ORIENTATION GROUP | POLE DENSITY OF {332}<113> CRYSTAL ORIENTATION | rC | rL | r30 | r60 | NOTE |
|---|---|---|---|---|---|---|---|---|---|---|---|
| A1 | 645 | 10 | 12 | 44.0 | 2.9 | 2.6 | 0.79 | 0.84 | 1.10 | 1.10 | COMPARATIVE STEEL |
| A2 | 560 | 6 | 9 | 36.0 | 1.7 | 2.0 | 0.74 | 0.79 | 1.06 | 1.04 | COMPARATIVE STEEL |
| A3 | 830 | 11 | 15 | 86.6 | 2.9 | 2.4 | 0.74 | 0.79 | 0.97 | 0.98 | COMPARATIVE STEEL |
| A4 | 751 | 12 | 18 | 44.0 | 1.8 | 2.4 | 0.58 | 0.63 | 1.21 | 1.31 | COMPARATIVE STEEL |
| A5 | 886 | 14 | 20 | 43.0 | 2.9 | 2.4 | 0.74 | 0.79 | 0.97 | 0.98 | COMPARATIVE STEEL |
| A6 | 779 | 13 | 18 | 39.0 | 2.9 | 2.4 | 0.74 | 0.79 | 0.97 | 0.98 | COMPARATIVE STEEL |
| B1 | 804 | 13 | 18 | 91.7 | 1.5 | 1.7 | 0.71 | 0.76 | 1.03 | 1.02 | PRESENT INVENTION STEEL |
| B2 | 914 | 14 | 19 | 82.8 | 2.1 | 2.6 | 0.71 | 0.76 | 1.07 | 1.05 | PRESENT INVENTION STEEL |
| B3 | 797 | 13 | 18 | 45.0 | 3.7 | 1.6 | 0.54 | 0.59 | 1.27 | 1.22 | COMPARATIVE STEEL |
| C1 | 737 | 12 | 18 | 95.4 | 1.7 | 2.5 | 0.71 | 0.76 | 1.03 | 1.02 | PRESENT INVENTION STEEL |
| C2 | 814 | 13 | 22 | 65.2 | 2.4 | 2.8 | 0.71 | 0.76 | 1.05 | 1.04 | COMPARATIVE STEEL |
| C3 | 708 | 12 | 17 | 96.6 | 1.9 | 2.7 | 0.54 | 0.59 | 1.22 | 1.01 | COMPARATIVE STEEL |
| D1 | 1083 | 11 | 15 | 48.0 | 2.7 | 3.0 | 0.71 | 0.76 | 1.03 | 1.02 | COMPARATIVE STEEL |
| D2 | 855 | 13 | 19 | 85.4 | 1.7 | 1.6 | 0.71 | 0.76 | 1.05 | 1.04 | PRESENT INVENTION STEEL |
| D3 | 1168 | 15 | 22 | 55.0 | 1.9 | 1.9 | 0.71 | 0.76 | 1.05 | 1.04 | COMPARATIVE STEEL |
| E1 | 904 | 14 | 19 | 82.6 | 2.1 | 2.5 | 0.72 | 0.77 | 1.07 | 1.06 | PRESENT INVENTION STEEL |
| E2 | 956 | 14 | 20 | 78.5 | 1.8 | 2.2 | 0.72 | 0.77 | 1.09 | 1.07 | PRESENT INVENTION STEEL |
| E3 | 668 | 12 | 17 | 90.0 | 3.3 | 3.4 | 0.72 | 0.77 | 1.06 | 1.04 | COMPARATIVE STEEL |
| F1 | 900 | 14 | 19 | 83.4 | 1.4 | 1.3 | 0.72 | 0.77 | 1.07 | 1.05 | PRESENT INVENTION STEEL |
| F2 | 954 | 14 | 20 | 78.4 | 2.1 | 2.1 | 0.72 | 0.77 | 1.08 | 1.07 | PRESENT INVENTION STEEL |
| F3 | 947 | 14 | 20 | 80.4 | 4.3 | 2.0 | 0.85 | 0.90 | 1.44 | 1.35 | PRESENT INVENTION STEEL |
| G1 | 1073 | 9 | 13 | 62.6 | 1.6 | 2.6 | 0.71 | 0.76 | 1.03 | 1.02 | COMPARATIVE STEEL |
| G2 | 817 | 13 | 19 | 39.0 | 5.2 | 4.5 | 0.69 | 0.74 | 1.23 | 1.18 | COMPARATIVE STEEL |
| H1 | 891 | 14 | 19 | 82.4 | 2.2 | 2.7 | 0.70 | 0.75 | 1.02 | 1.02 | PRESENT INVENTION STEEL |
| I1 | 997 | 14 | 20 | 75.9 | 2.5 | 2.2 | 0.72 | 0.77 | 1.07 | 1.05 | PRESENT INVENTION STEEL |
| I2 | 657 | 12 | 17 | 99.5 | 3.1 | 3.1 | 0.74 | 0.79 | 1.11 | 1.09 | PRESENT INVENTION STEEL |
| I3 | 881 | 14 | 19 | 46.0 | 2.3 | 1.6 | 0.74 | 0.79 | 1.09 | 1.09 | COMPARATIVE STEEL |
| J1 | 959 | 14 | 20 | 78.9 | 2.0 | 2.7 | 0.72 | 0.77 | 1.07 | 1.06 | PRESENT INVENTION STEEL |
| J2 | 854 | 13 | 19 | 44.0 | 2.5 | 2.4 | 0.74 | 0.79 | 1.09 | 1.09 | COMPARATIVE STEEL |
| J3 | 953 | 14 | 20 | 39.0 | 4.8 | 4.3 | 0.55 | 0.60 | 1.09 | 1.09 | COMPARATIVE STEEL |
| K1 | 365 | 16 | 22 | 32.0 | 1.5 | 2.2 | 0.70 | 0.75 | 1.05 | 1.04 | COMPARATIVE STEEL |
| L1 | 853 | 12 | 17 | 85.9 | 1.5 | 2.2 | 0.71 | 0.76 | 1.06 | 1.04 | PRESENT INVENTION STEEL |
| M1 | 727 | 12 | 17 | 95.5 | 2.9 | 3.6 | 0.70 | 0.75 | 1.04 | 1.03 | PRESENT INVENTION STEEL |
| M2 | 936 | 14 | 20 | 38.0 | 4.1 | 0.9 | 0.88 | 0.93 | 1.04 | 1.03 | COMPARATIVE STEEL |
| N1 | 883 | 14 | 19 | 82.9 | 1.9 | 2.6 | 0.70 | 0.75 | 1.05 | 1.04 | PRESENT INVENTION STEEL |
| O1 | 852 | 13 | 19 | 85.8 | 1.8 | 2.0 | 0.70 | 0.75 | 1.03 | 1.02 | PRESENT INVENTION STEEL |
| O2 | 764 | 13 | 18 | 41.0 | 5.6 | 4.4 | 0.55 | 0.60 | 1.46 | 1.37 | COMPARATIVE STEEL |
| P1 | 873 | 13 | 19 | 84.1 | 2.2 | 3.3 | 0.71 | 0.76 | 1.04 | 1.03 | PRESENT INVENTION STEEL |

TABLE 5-continued

| STEEL TYPE | TS (Mpa) | u-EL(%) | EL(%) | λ(%) | AVERAGE VALUE OF POLE DENSITIES OF {100}<011> TO {223}<110> ORIENTATION GROUP | POLE DENSITY OF {332}<113> CRYSTAL ORIENTATION | rC | rL | r30 | r60 | NOTE |
|---|---|---|---|---|---|---|---|---|---|---|---|
| P2 | 1051 | 9 | 10 | 26.1 | 6.1 | 5.8 | 0.49 | 0.54 | 1.51 | 1.21 | COMPARATIVE STEEL |
| P3 | 1042 | 9 | 10 | 25.8 | 6.0 | 5.8 | 0.48 | 0.55 | 1.49 | 1.25 | COMPARATIVE STEEL |
| P4 | 1113 | 6 | 7 | 23.1 | 1.8 | 2.2 | 0.72 | 0.77 | 1.09 | 1.07 | COMPARATIVE STEEL |
| Q1 | 818 | 13 | 19 | 88.9 | 2.3 | 2.7 | 0.71 | 0.76 | 1.04 | 1.03 | PRESENT INVENTION STEEL |
| Q2 | 485 | 12 | 13 | 55.0 | 2.5 | 2.2 | 0.72 | 0.77 | 1.07 | 1.05 | COMPARATIVE STEEL |
| Q3 | 568 | 10 | 11 | 51.2 | 1.5 | 1.7 | 0.71 | 0.76 | 1.03 | 1.02 | COMPARATIVE STEEL |
| Q4 | 657 | 11 | 12 | 34.0 | 3.1 | 3.1 | 0.74 | 0.79 | 1.11 | 1.09 | COMPARATIVE STEEL |
| R1 | 752 | 13 | 18 | 93.3 | 2.6 | 3.1 | 0.71 | 0.76 | 1.04 | 1.03 | PRESENT INVENTION STEEL |
| R2 | 1080 | 17 | 24 | 74.0 | 2.6 | 3.0 | 0.69 | 0.74 | 1.03 | 1.04 | PRESENT INVENTION STEEL |
| R3 | 1073 | 17 | 24 | 73.7 | 2.5 | 2.9 | 0.77 | 0.82 | 1.02 | 1.02 | PRESENT INVENTION STEEL |
| R4 | 1060 | 16 | 23 | 74.3 | 2.3 | 2.6 | 0.72 | 0.77 | 1.04 | 1.03 | PRESENT INVENTION STEEL |
| S1 | 868 | 13 | 19 | 85.8 | 1.6 | 2.1 | 0.71 | 0.76 | 1.05 | 1.04 | PRESENT INVENTION STEEL |
| S2 | 1020 | 16 | 22 | 77.0 | 2.0 | 2.4 | 0.72 | 0.77 | 1.05 | 1.03 | PRESENT INVENTION STEEL |
| S3 | 1050 | 16 | 23 | 74.9 | 1.9 | 2.3 | 0.71 | 0.76 | 1.02 | 1.03 | PRESENT INVENTION STEEL |
| S4 | 1020 | 15 | 21 | 75.2 | 1.5 | 1.8 | 0.78 | 0.83 | 1.08 | 1.04 | PRESENT INVENTION STEEL |
| T1 | 780 | 13 | 18 | 92.1 | 1.8 | 1.9 | 0.71 | 0.76 | 1.07 | 1.05 | PRESENT INVENTION STEEL |
| 72 | 720 | 12 | 17 | 39 | 5.7 | 4.6 | 0.52 | 0.57 | 1.47 | 1.39 | COMPARATIVE STEEL |
| T3 | 735 | 12 | 17 | 41 | 5.5 | 4.3 | 0.53 | 0.58 | 1.45 | 1.37 | COMPARATIVE STEEL |
| T4 | 986 | 15 | 21 | 36 | 5.5 | 4.4 | 0.55 | 0.60 | 1.44 | 1.40 | COMPARATIVE STEEL |
| T5 | 998 | 16 | 22 | 35 | 6.2 | 5.1 | 0.58 | 0.63 | 1.57 | 1.42 | COMPARATIVE STEEL |
| T6 | 898 | 14 | 20 | 32 | 6.1 | 4.6 | 0.55 | 0.60 | 1.62 | 1.41 | COMPARATIVE STEEL |
| T7 | 880 | 6 | 9 | 33 | 6.2 | 4.7 | 0.57 | 0.62 | 1.59 | 1.44 | COMPARATIVE STEEL |
| a1 | CRACKING OCCURRED DURING HOT ROLLING | | | | | | | | | | COMPARATIVE STEEL |
| b1 | | | | | | | | | | | COMPARATIVE STEEL |
| c1 | | | | | | | | | | | COMPARATRIE STEEL |
| d1 | | | | | | | | | | | COMPARATIVE STEEL |
| e1 | | | | | | | | | | | COMPARATIVE STEEL |
| f1 | | | | | | | | | | | COMPARATIVF STEEL |
| g1 | | | | | | | | | | | COMPARATIVE STEEL |
| h1 | | | | | | | | | | | COMPARATIVE STEEL |

INDUSTRIAL APPLICABILITY

As described previously, according to the present invention, it is possible to provide a high-strength cold-rolled steel sheet that is not large in anisotropy even when Nb, Ti, and/or the like are/is added and has excellent uniform elongation and hole expandability. Thus, the present invention is the invention having high industrial applicability.

EXPLANATION OF CODES

1 continuous hot rolling line
2 roughing mill
3 finishing mill
4 hot-rolled steel sheet
5 run-out-table
6 rolling stand
10 inter-stand cooling nozzle
11 cooling nozzle 11

The invention claimed is:

1. A manufacturing method of a high-strength cold-rolled steel sheet having excellent uniform elongation and hole expandability, comprising:

on a steel billet containing:

in mass %,

C: 0.01 to 0.4%;

Si: 0.001 to 2.5%;

Mn: 0.001 to 4.0%;

P: 0.001 to 0.15%;

S: 0.0005 to 0.03%;

Al: 0.001 to 2.0%;

N: 0.0005 to 0.01%; and

O: 0.0005 to 0.01%; in which Si+Al is limited to less than 1.0%, and a balance being composed of iron and inevitable impurities, performing first hot rolling in which rolling at a reduction ratio of 40% or more is performed one time or more in a temperature range of not lower than 1000° C. nor higher than 1200° C.;

setting an austenite grain diameter to 200 μm or less by the first hot rolling;

performing second hot rolling in which rolling at a reduction ratio of 30% or more is performed in one pass at least one time in a temperature region of not lower than a temperature T1+30° C. nor higher than T1+200° C. determined by Expression (1) below;

setting the total reduction ratio in the second hot rolling to 50% or more;

performing final reduction at a reduction ratio of 30% or more in the second hot rolling and then starting pre-cold rolling primary cooling in such a manner that a waiting time t second satisfies Expression (2) below;

setting an average cooling rate in the primary cooling to 50° C./second or more and performing the primary cooling in a manner that a temperature change is in a range of not less than 40° C. nor more than 140° C.;

performing cold rolling at a reduction ratio of not less than 30% nor more than 70%;

performing heating up to a temperature region of 700 to 900° C. and performing holding for not shorter than 1 second nor longer than 1000 seconds;

performing post-cold rolling primary cooling down to a temperature region of 580 to 750° C. at an average cooling rate of 12° C./second or less;

performing post-cold rolling secondary cooling down to a temperature region of 350 to 500° C. at an average cooling rate of 4 to 300° C./second; and performing an overaging heat treatment in which holding is performed for not shorter than t2 seconds satisfying Expression (4) below nor longer than 400 seconds in a temperature region of not lower than 350° C. nor higher than 500° C., $$T1(°\ C.)=850+10\times(C+N)\times Mn+350\times Nb+250\times Ti+40\times B+10\times Cr+100\times Mo+100\times V \quad (1)$$

wherein, C, N, Mn, Nb, Ti, B, Cr, Mo, and V each represent the content of the element (mass %), $$t\leq 2.5\times t1 \quad (2)$$

wherein, t1 is obtained by Expression (3) below, $$t1=0.001\times((Tf-T1)\times P1/100)^2-0.109\times((Tf-T1)\times P1/100)+3.1 \quad (3)$$

wherein, in Expression (3) above, Tf represents the temperature of the steel billet obtained after the final reduction at a reduction ratio of 30% or more, and P1 represents the reduction ratio of the final reduction at 30% or more, $$\log(t2)=0.0002(T2-425)^2+1.18 \quad (4)$$

wherein, T2 represents an overaging treatment temperature, and the maximum value of t2 is set to 400.

2. The manufacturing method of the high-strength cold-rolled steel sheet having excellent uniform elongation and hole expandability according to claim 1, further comprising:

after performing the pre-cold rolling primary cooling, performing pre-cold rolling secondary cooling down to a cooling stop temperature of 600° C. or lower at an average cooling rate of 10 to 300° C./second before performing the cold rolling, and performing coiling at 600° C. or lower to obtain a hot-rolled steel sheet.

3. The manufacturing method of the high-strength cold-rolled steel sheet having excellent uniform elongation and hole expandability according to claim 1, wherein the total reduction ratio in a temperature range of lower than T1+30° C. is 30% or less.

4. The manufacturing method of the high-strength cold-rolled steel sheet having excellent uniform elongation and hole expandability according to claim 1, wherein the waiting time t second further satisfies Expression (2a) below, $$t<t1 \quad (2a).$$

5. The manufacturing method of the high-strength cold-rolled steel sheet having excellent uniform elongation and hole expandability according to claim 1, wherein the waiting time t second further satisfies Expression (2b) below, $$t1\leq t\leq t1\times 2.5 \quad (2b),$$

6. The manufacturing method of the high-strength cold-rolled steel sheet having excellent uniform elongation and hole expandability according to claim 1, wherein post-hot rolling primary cooling is started between rolling stands.

7. The manufacturing method of the high-strength cold-rolled steel sheet having excellent uniform elongation and hole expandability according to claim 1, wherein when the heating is performed up to the temperature region of 700 to 900° C. after the cold rolling, an average heating rate of not lower than room temperature nor higher than 650° C. is set to HR1 (° C./second) expressed by Expression (5) below, and an average heating rate of higher than 650° C. to a temperature region of 700 to 900° C. is set to HR2 (° C./second) expressed by Expression (6) below, $$HR1\geq 0.3 \quad (5)$$

$$HR2\leq 0.5\times HR1 \quad (6).$$

8. The manufacturing method of the high-strength cold-rolled steel sheet having excellent uniform elongation and hole expandability according to claim 1, further comprising:

performing hot-dip galvanizing on the surface.

9. The manufacturing method of the high-strength cold-rolled steel sheet having excellent uniform elongation and hole expandability according to claim 8, further comprising:

performing an alloying treatment at 450 to 600° C. after performing the hot-dip galvanizing.

* * * * *